US007792460B2

(12) United States Patent
Yamaguchi et al.

(10) Patent No.: US 7,792,460 B2
(45) Date of Patent: Sep. 7, 2010

(54) PROCESS CARTRIDGE HAVING CARTRIDGE POSITIONING PORTION AND IMAGE FORMING APPARATUS MOUNTING SAID PROCESS CARTRIDGE

(75) Inventors: Koji Yamaguchi, Numazu (JP); Henrique Massanori Oka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/396,878

(22) Filed: Mar. 3, 2009

(65) Prior Publication Data

US 2009/0180799 A1 Jul. 16, 2009

Related U.S. Application Data

(62) Division of application No. 11/466,695, filed on Aug. 23, 2006, now Pat. No. 7,519,310, which is a division of application No. 11/059,414, filed on Feb. 17, 2005, now Pat. No. 7,116,925.

(30) Foreign Application Priority Data

Feb. 20, 2004 (JP) ..... 2004-044501
Feb. 8, 2005 (JP) ..... 2005-031850

(51) Int. Cl.
*G03G 21/16* (2006.01)

(52) U.S. Cl. ..... 399/111; 399/262

(58) Field of Classification Search ..... 399/111, 399/112, 262; 222/DIG. 1
See application file for complete search history.

(56) References Cited

U.S. PATENT DOCUMENTS 5,365,315 A 11/1994 Baker et al. ..... 399/111
5,848,329 A 12/1998 Aoyama et al. ..... 399/113
6,483,527 B2 11/2002 Kaneko et al. ..... 347/138
6,535,705 B2 3/2003 Asakura et al. ..... 399/111
6,681,088 B2 1/2004 Kanno et al. ..... 399/111
6,782,219 B2 8/2004 Yoshino et al. ..... 399/90
6,834,173 B2 12/2004 Yamaguchi et al. ..... 399/119
6,920,298 B2 7/2005 Yamada et al. ..... 399/262

(Continued)

FOREIGN PATENT DOCUMENTS

JP 2001-142274 5/2001

(Continued)

*Primary Examiner*—David M Gray
*Assistant Examiner*—Laura K Roth
(74) *Attorney, Agent, or Firm*—Fitzpatrick, Cella, Harper & Scinto

(57) ABSTRACT

A process cartridge is detachably mountable to a main assembly of an electrophotographic image forming apparatus. The cartridge includes an electrophotographic photosensitive drum, a process device actable on the drum, a cartridge positioning portion for engaging a main assembly positioning portion to position the cartridge with respect to a direction crossing the direction of the axis of the drum when the cartridge is mounted to the main assembly in a direction parallel with the axis of the photosensitive drum, and a movable member movable between a first position contacting the main assembly in the process of mounting of the cartridge to the main assembly, and a second position contacting a main assembly urging member and receiving a force in the crossing direction to contact the cartridge positioning portion to the main assembly positioning portion to position the cartridge in the crossing direction, when the cartridge is mounted to the main assembly.

3 Claims, 24 Drawing Sheets

U.S. PATENT DOCUMENTS

| | | | | |
|---|---|---|---|---|
| 6,983,115 | B2 | 1/2006 | Isobe et al. | 399/119 |
| 6,993,264 | B2 | 1/2006 | Oguma et al. | 399/111 |
| 7,116,925 | B2 | 10/2006 | Yamaguchi | 399/111 |
| 7,194,225 | B2 | 3/2007 | Yamaguchi | 399/111 |
| 2001/0021320 | A1 * | 9/2001 | Murayama et al. | 399/111 |
| 2004/0037587 | A1 | 2/2004 | Yamaguchi et al. | 399/119 |
| 2004/0105698 | A1 | 6/2004 | Yamaguchi et al. | 399/109 |
| 2004/0114961 | A1 | 6/2004 | Yoshino et al. | 399/119 |
| 2005/0008395 | A1 | 1/2005 | Yamaguchi et al. | 399/119 |
| 2005/0176299 | A1 | 8/2005 | Chadani et al. | 439/607 |

FOREIGN PATENT DOCUMENTS

| | | |
|---|---|---|
| JP | 2003-271038 | 9/2003 |

* cited by examiner

PROCESS CARTRIDGE HAVING CARTRIDGE POSITIONING PORTION AND IMAGE FORMING APPARATUS MOUNTING SAID PROCESS CARTRIDGE

CROSS-REFERENCE TO RELATED APPLICATIONS

This application is a divisional of U.S. patent application Ser. No. 11/466,695, filed Aug. 23, 2006, now allowed, which is a divisional of U.S. patent application Ser. No. 11/059,414, filed Feb. 17, 2005, now U.S. Pat. No. 7,116,925, issued on Oct. 3, 2006. U.S. application Ser. No. 11/455,632, filed Jun. 20, 2006 and now issued as U.S. Pat. No. 7,184,687 on Feb. 27, 2007, is a Divisional Application of U.S. application Ser. No. 11/059,414 filed Feb. 17, 2005, now U.S. Pat. No. 7,116,925, issued on Oct. 3, 2006.

FIELD OF THE INVENTION AND RELATED ART

The present invention relates to a process cartridge, and an electrophotographic image forming apparatus in which a process cartridge is removably mountable.

Here, an electrophotographic image forming apparatus is an apparatus which forms an image on a recording medium (for example, recording paper, an OHP sheet, etc.) with the use of one of the electrophotographic image forming methods. As for examples of an image forming apparatus, an electrophotographic copying machine, an electrophotographic printer (for example, laser printer, LED printer, etc.) a facsimile machine, a word processor, etc. are included.

A process cartridge is a cartridge in which at least one processing means among a charging means, a developing means, and a cleaning means, and an electrophotographic photosensitive drum, are integrally disposed, and which is removably mountable in the main assembly of an image forming apparatus. Therefore, it includes a cartridge in which at least a developing means as a processing means, and an electrophotographic photosensitive drum are integrally disposed, and which is removably mountable in the main assembly of an image forming apparatus.

An electrophotographic color image forming apparatus of the in-line type, has been known quite some time, which is structured so that a plurality of process cartridges (which hereinafter may be referred to simply as a cartridge) are disposed in a straight line. In the case of this structural arrangement, an electrostatic latent image is formed on the photosensitive drum. Therefore, if the direction in which a beam of laser light is oscillated to scan the peripheral surface of a photosensitive drum is not parallel to the photosensitive drum, an image suffering from color deviation is formed. Thus, it is extremely important to precisely position in parallel a plurality of scanner units relative to a plurality of photosensitive drums, one for one.

For example, U.S. Pat. No. 6,483,527 discloses a structural arrangement which provides the left and right lateral plates in the main assembly of an image forming apparatus, with recesses in which scanner units and photosensitive drums are supported. More specifically, the portions of each scanner unit, by which the scanner is supported, and the bearings attached to the lengthwise ends of each photosensitive drum, are elastically pressed on the surfaces of the corresponding recesses, so that the scanner unit, and photosensitive drums are accurately positioned relative to the same lateral plates. With the provision of this structural arrangement, the scanner unit and corresponding photosensitive drum are accurately and precisely positioned relative to each other, without the presence of any play. Obviously, the amount of the pressure to be applied to the aforementioned portions of the scanner unit and photosensitive drum must be large enough to overcome the external force, and vibrations, to which they are subjected.

U.S. Pat. No. 5,848,329 discloses the following structural arrangement for an electrophotographic color image forming apparatus in which a plurality of cartridges are removably mountable in the direction parallel to the axial line of each photosensitive drum. According to this structural arrangement, the cartridges are supported by the front and rear lateral plates of the main assembly of the image forming apparatus; the end of the shaft of the photosensitive drum, on the rear side, that is, the side from which the photosensitive drum is driven, is supported by the rear lateral plate, and the front end of the cartridge is precisely positioned relative to the supporting member.

Further, Japanese Laid-open Patent Application 2001-142274 discloses the following structural arrangement for an image forming apparatus. According to this application, after the mounting of the photosensitive drum into the main assembly of the image forming apparatus, a pressing means, the movement of which is controlled by the movement of another unit, applies pressure upon the photosensitive drum, causing the lengthwise ends of the shaft of the photosensitive drum to be placed directly in contact with the frame of the main assembly, so that the cartridge, containing the photosensitive drum, is accurately positioned relative to the main assembly.

As for the process for mounting a cartridge into the main assembly of an image forming apparatus, or removing it therefrom, it is desired to be as simple as possible, and require as small a force as possible. Further, a cartridge is desired to be as simple as possible in terms of the process for mounting or dismounting it, and structured so that after being mounted into the main assembly, it is precisely positioned relative to the main assembly by being pressed upon the supporting portion with which the apparatus main assembly is provided.

SUMMARY OF THE INVENTION

The primary object of the present invention is to provide an electrophotographic image forming apparatus which more precisely positions a process cartridge relative to the main assembly of the image forming apparatus than an electrophotographic image forming apparatus in accordance with the prior art, and a process cartridge which is more precisely positioned relative to the main assembly of an electrophotographic image forming apparatus than a process cartridge in accordance with the prior art.

Another object of the present invention is to provide an electrophotographic image forming apparatus superior to an electrophotographic image forming apparatus in accordance with the prior art, in terms of the operability during the mounting of a process cartridge into the main assembly of the image forming apparatus, and a process cartridge superior to a process cartridge in accordance with the prior art, in terms of the operability during the mounting of it into the main assembly of an electrophotographic image forming apparatus.

Another object of the present invention is to provide an electrophotographic image forming apparatus substantially smaller in the amount of force required to mount a process cartridge into the main assembly of the image forming apparatus than an electrophotographic image forming apparatus in accordance with the prior art, and a process cartridge substantially smaller in the amount of force required to mount the process cartridge into the main assembly of an electrophotographic image forming apparatus.

According to an aspect of the present invention, there is provided a process cartridge detachably mountable to a main assembly of an electrophotographic image forming apparatus, the process cartridge comprising: an electrophotographic photosensitive drum; process means actable on the electrophotographic photosensitive drum; a cartridge positioning portion for engagement with a main assembly positioning portion provided in the main assembly of the apparatus to position the process cartridge with respect to a direction crossing with the direction of the axis of the electrophotographic photosensitive drum, when the process cartridge is mounted to the main assembly of the apparatus in a direction parallel with the axis of the photosensitive drum; and a movable member provided at a downstream position with respect to a mounting direction in which the process cartridge is mounted to the main assembly of the apparatus, the movable member is movable between a first position at which the movable member contacts the main assembly of the apparatus in the mounting direction in the process of mounting of the process cartridge to the main assembly of the apparatus, and a second position in which the movable member is contacted by an urging member provided in the main assembly of the apparatus and receives a force in the crossing direction so as to contact the cartridge positioning portion to the main assembly positioning portion to position the process cartridge in the crossing direction, when the process cartridge is mounted to the main assembly of the apparatus.

According to another aspect of the present invention, there is provided an electrophotographic image forming apparatus, for forming an image on a recording material, to which a process cartridge is detachably mountable, the apparatus comprising: (i) a main assembly positioning portion; (ii) an urging member; (iii) mounting means for detachably mounting a process cartridge, the process cartridge including, an electrophotographic photosensitive drum; process means actable on the electrophotographic photosensitive drum; a cartridge positioning portion for engagement with the main assembly positioning portion provided in the main assembly of the apparatus to position the process cartridge with respect to a direction crossing the direction of the axis of the electrophotographic photosensitive drum, when the process cartridge is mounted to the main assembly of the apparatus in a direction parallel with the axis of the photosensitive drum; and a movable member provided at a downstream position with respect to a mounting direction in which the process cartridge is mounted to the main assembly of the apparatus, the movable member being movable between a first position at which the movable member contacts the main assembly of the apparatus in the mounting direction in the process of mounting of the process cartridge to the main assembly of the apparatus, and a second position in which the movable member is contacted by the urging member provided in the main assembly of the apparatus and receives a force in the crossing direction so as to contact the cartridge positioning portion to the main assembly positioning portion to position the process cartridge in the crossing direction, when the process cartridge is mounted to the main assembly of the apparatus; and (iv) feeding means for feeding the recording material.

According to a further aspect of the present invention, there is provided a process cartridge detachably mountable to a main assembly of an electrophotographic image forming apparatus, the process cartridge comprising: an electrophotographic photosensitive drum; process means actable on the electrophotographic photosensitive drum; a cartridge positioning portion for engagement with a main assembly positioning portion provided in the main assembly of the apparatus to position the process cartridge with respect to a direction crossing with the direction of the axis of the electrophotographic photosensitive drum, when the process cartridge is mounted to the main assembly of the apparatus in a direction parallel with the axis of the photosensitive drum; and a member to be urged provided at a downstream position with respect to a mounting direction in which the process cartridge is mounted to the main assembly of the apparatus, the portion to be urged includes a first portion to be urged for contacting a movable urging member provided in the main assembly of the apparatus for movement in the mounting direction in the process of mounting of the process cartridge to the main assembly of the apparatus, and a second portion to be urged for contacting the urging member to receive a force in the crossing direction so as to contact the cartridge positioning portion to the main assembly positioning portion to position the process cartridge in the crossing direction, when the process cartridge is mounted to the main assembly of the apparatus.

According to a further aspect of the present invention, there is provided an electrophotographic image forming apparatus, for forming an image on a recording material, to which a process cartridge is detachably mountable, the apparatus comprising: (i) a main assembly positioning portion; (ii) a movable urging member; (iii) mounting means for detachably mounting a process cartridge, the process cartridge including: an electrophotographic photosensitive drum; process means actable on the electrophotographic photosensitive drum; a cartridge positioning portion for engagement with the main assembly positioning portion provided in the main assembly of the apparatus to position the process cartridge with respect to a direction crossing with the direction of the axis of the electrophotographic photosensitive drum, when the process cartridge is mounted to the main assembly of the apparatus in a direction parallel with the axis of the photosensitive drum; and a member to be urged provided at a downstream position with respect to a mounting direction in which the process cartridge is mounted to the main assembly of the apparatus, the portion to be urged includes a first portion to be urged for contacting the movable urging member provided in the main assembly of the apparatus for movement in the mounting direction in the process of mounting of the process cartridge to the main assembly of the apparatus, and a second portion to be urged for contacting the urging member to receive a force in the crossing direction so as to contact the cartridge positioning portion to the main assembly positioning portion to position the process cartridge in the crossing direction, when the process cartridge is mounted to the main assembly of the apparatus; and (iv) feeding means for feeding the recording material.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(1) General Structure of Electrophotographic Image Forming Apparatus

Figure 1:
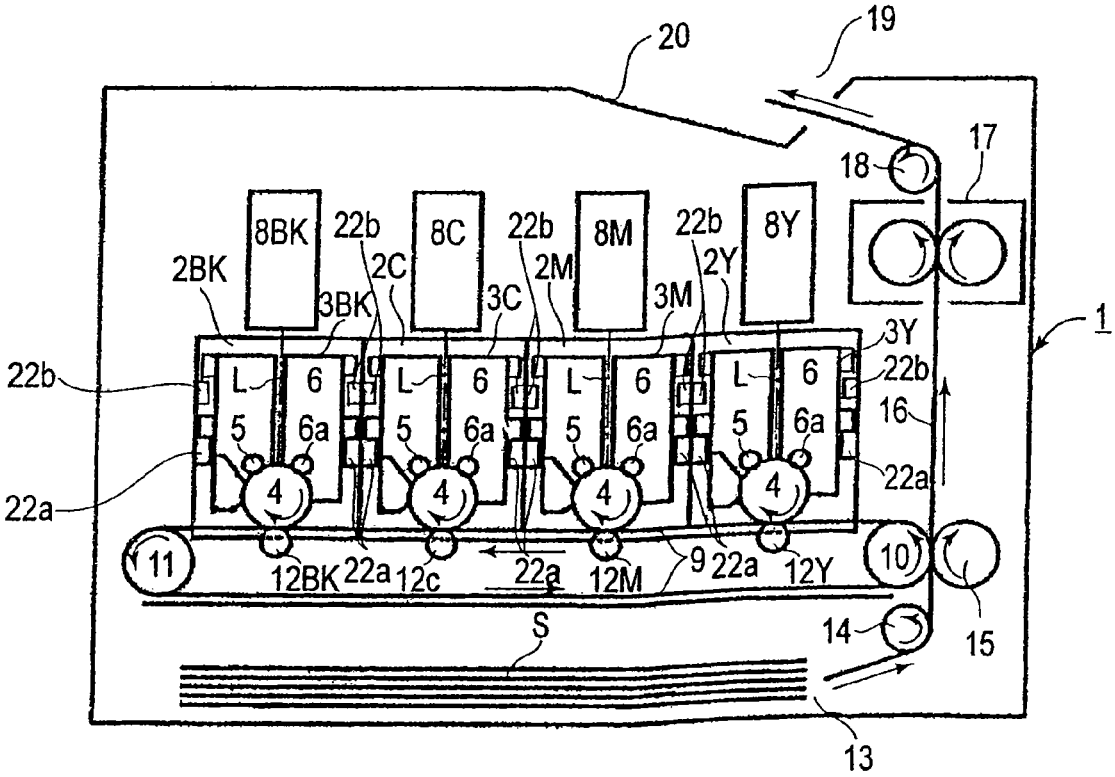
FIG. 1 is a schematic sectional view of the image forming apparatus in the first embodiment of the present invention.

FIG. 1 is a sectional view of the electrophotographic image forming apparatus in the first embodiment of the present invention. The image forming apparatus in this embodiment is an electrophotographic full-color image forming apparatus which employs one of the electrophotographic processes. This electrophotographic image forming apparatus is of an in-line type (tandem type); it employs a plurality of cartridges, which are mounted in the apparatus, in parallel and in alignment in the horizontal direction. It also employs an intermediary transfer belt.

The main assembly 1 of the image forming apparatus has four process cartridge compartments (which hereinafter will be referred to simply as cartridge compartments): first to fourth cartridge compartments 2Y, 2M, 2C, and 2Bk, which are aligned in parallel in the right to left direction in the drawing, in the main assembly 1.

In the cartridge compartments 2Y, 2M, 2C, and 2Bk, four process cartridges 3Y, 3M, 3C, and 3BK (which hereinafter will be referred to simply as cartridges) as first to fourth image formation stations are removably mountable.

All cartridges 3Y, 3M, 3C, and 3Bk are similar in structure. Each cartridge 3 has: an electrophotographic photosensitive drum 4 (which hereinafter will be referred to simply as a photosensitive drum); a charge roller 5 as a charging means for uniformly charging the photosensitive drum 4; a development unit 6 for developing, with the use of developer, an electrostatic latent image formed on the photosensitive drum 4; and a cleaning means 7 for removing the developer remaining adhered to the peripheral surface of the photosensitive drum 4.

The first cartridge 3Y has a development unit 6 which contains developer of a yellow color, and forms an image, of the yellow developer, on the peripheral surface of the photosensitive drum 4. The second cartridge 3M has a development unit 6 which contains developer of a magenta color, and forms an image, of the magenta developer, on the peripheral surface of the photosensitive drum 4. The third cartridge 3C has a development unit 6 which contains developer of a cyan color, and forms an image, of the cyan developer, on the peripheral surface of the photosensitive drum 4. The fourth cartridge 3Bk has a development unit 6 which contains developer of a black color, and forms an image, of the black developer, on the peripheral surface of the photosensitive drum 4.

Also referring to FIG. 1, the main assembly 1 of the image forming apparatus is provided with four scanner units: first to fourth scanner units 8Y, 8M, 8C, and 8Bk, which are disposed above the cartridge compartments 2Y, 2M, 2C, and 2Bk, respectively. From the scanner units 8Y, 8M, 8C, and 8Bk, a beam of laser light L is projected onto the peripheral surfaces of the corresponding photosensitive drums 4, in a manner of scanning the peripheral surfaces of the photosensitive drums 4, while being modulated with image formation data, so that electrostatic latent images in accordance with the image formation data are formed on the peripheral surfaces of the photosensitive drums 4, one for one.

The main assembly 1 of the image forming apparatus is also provided with an intermediary transfer belt 9, which is disposed under the cartridge compartments for the cartridges 3Y, 3M, 3C, and 3Bk, and is stretched between a driver roller 10 and a tension roller 11, being wrapped around the rollers.

The transfer belt 9 is stretched along the cartridges 3Y, 3M, 3C, and 3Bk, and is circularly moved. It contacts the downwardly exposed portion of the peripheral surface of the photosensitive drum 4 in each of the first to fourth cartridges 3Y, 3M, 3C, and 3Bk positioned above the belt 9, by its portion moving through the top portion of its track comprising the top and bottom portions parallel to each other.

Further, the main assembly 1 of the image forming apparatus is provided with four primary transfer rollers (first to fourth transfer rollers 12Y, 12M, 12C, and 12Bk), which are kept pressured against the photosensitive drums 4 of the cartridges 3Y, 3M, 3C, and 3Bk, one for one, with the transfer belt 9 pinched between each transfer roller and corresponding photosensitive drum 4.

The main assembly 1 of the image forming apparatus is also provided with a recording medium feeding portion 13, which is located below the transfer belt 9. The recording medium feeding portion 13 stores a plurality of recording media S. The recording media S in the recording medium feeding portion 13 are fed out therefrom, while being separated one by one, by a conveying means (unshown) in response to a feed signal.

The main assembly 1 is also provided with a secondary transfer roller 15, which is kept pressed against the driver roller 10, with the transfer belt 9 pinched between the two rollers 15 and 10. In other words, the secondary transfer roller 15 forms the secondary transfer nip between it and the transfer belt 9. After being conveyed from the recording medium feeding portion 13, each recording medium S is conveyed to the secondary transfer nip by a conveying means 14.

The process of forming a full-color image is as follows: First, the cartridges 3Y, 3M, 3C, and 3Bk begin to be sequentially driven in accordance with image formation timing, so that the photosensitive drum 4 in each cartridge is rotated in the clockwise direction (indicated by arrow mark in FIG. 1), and also, so that the transfer belt 9 is rotated in the counterclockwise direction. Next, the scanner units 8Y, 8M, 8C, and 8Bk opposing the cartridges 3Y, 3M, 3C, and 3Bk, respectively, begin to be sequentially driven, and the charge rollers 5 begin to uniformly charge the peripheral surfaces of the corresponding photosensitive drums 4 in synchronism with the driving of the photosensitive drums 4. The uniformly charged portion of each photosensitive drum 4 is exposed to the beam of laser light, which is projected in an oscillatory manner from the corresponding scanner unit (8Y, 8M, 8C, or 8Bk) while being modulated with video signals. As a result, four electrostatic latent images are formed on the four photosensitive drums 4, one for one. These electrostatic latent images are developed by the development rollers 6*a* as developing means, with which the development units 6 are provided, one for one.

Through the above-described electrophotographic image formation process, an image is formed of developer on the peripheral surface of each photosensitive drum 4, in accordance with the predetermined control timing. More specifically, an image is formed of the developer of the yellow color, or one of the color components of a full-color image, on the peripheral surface of the photosensitive drum 4 of the first cartridge 3Y; an image is formed of the developer of the magenta color, or one of the color components of a full-color image, on the peripheral surface of the photosensitive drum 4 of the second cartridge 3M; an image is formed of the developer of the cyan color, or one of the color components of a full-color image, on the peripheral surface of the photosensitive drum 4 of the third cartridge 3C; and an image is formed of the developer of the black color, or one of the color components of a full-color image, on the peripheral surface of the photosensitive drum 4 of the black cartridge 3Bk.

Then, the images formed of the aforementioned developers, on the peripheral surfaces of the photosensitive drums 4 of the cartridges 3Y, 3M, 3C, and 3Bk, respectively, are sequentially transferred in layers, while being precisely aligned with each other, onto the outward surface of the transfer belt 9 in terms of its elongated circulatory track, by the primary transfer rollers 12Y, 12M, 12C, and 12Bk), in the corresponding primary transfer stations. As a result, a single unfixed full-color image is formed on the outward surface of the transfer belt 9, of the toner images formed of the above-mentioned developers.

Then, the unfixed full-color image on the outward surface of the transfer belt 9 is moved by the circulatory movement of the transfer belt 9 to the secondary transfer nip, in which the unfixed full-color image, or the layered four monochromatic images different in color, are transferred all at once by the secondary transfer roller 15, onto the recording medium S delivered from the recording medium feeding portion 13 in synchronism with the arrival of the unfixed full-color image thereto. Thereafter, the recording medium S is conveyed upward through a vertical sheet path 16, to a fixing portion 17, in which the images formed of the developers are thermally fixed. Then, the recording medium S is conveyed by a conveying means 18 to a sheet discharge portion 19, from which it is discharged into a delivery tray 20. It should be noted here that during the above-described transfer steps, voltage is applied to the transfer rollers 12 and 15.

(2) Method for Mounting Process Cartridge

Next, the method for mounting the cartridges 3Y, 3M, 3C, and 3Bk (each of which hereinafter may be referred to as cartridge 3) into the main assembly 1 of the image forming apparatus will be described.

Figure 2:
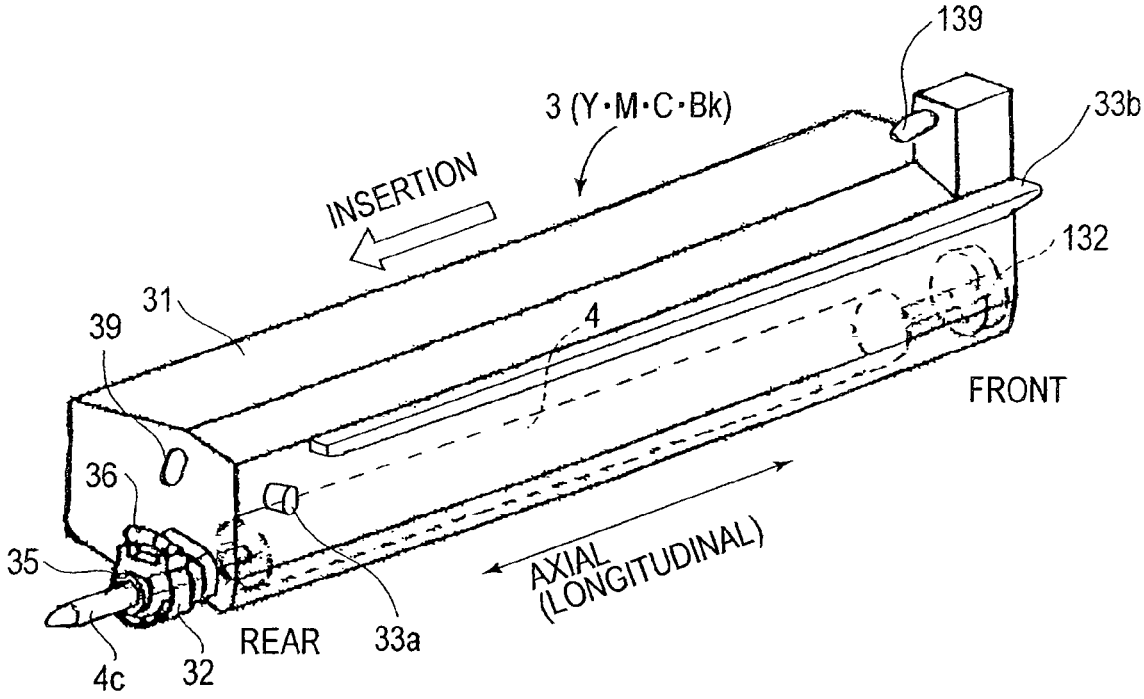
FIG. 2 is a schematic external perspective view of a process cartridge.

FIG. 2 is an external perspective view of the cartridge 3. One of the lengthwise ends of the shaft 4*c* of the photosensitive drum 4 of the cartridge 3 is rotatably supported by a bearing member 32 located at one of the lengthwise ends of the cartridge frame 31, whereas the other lengthwise end of the shaft 4*c* of the photosensitive drum 4 is rotatably supported by a bearing member 132 located at the other lengthwise end of the cartridge frame 31. In this embodiment, when mounting the cartridge 3 into the main assembly 1 of the image forming apparatus (which hereinafter will be referred to simply as the apparatus main assembly 1), the cartridge 3 is inserted in the direction parallel to the axial line of the photosensitive drum 4, that is, direction perpendicular to the surface of FIG. 1, from the front side to the rear side of the apparatus main assembly 1.

Figure 3:
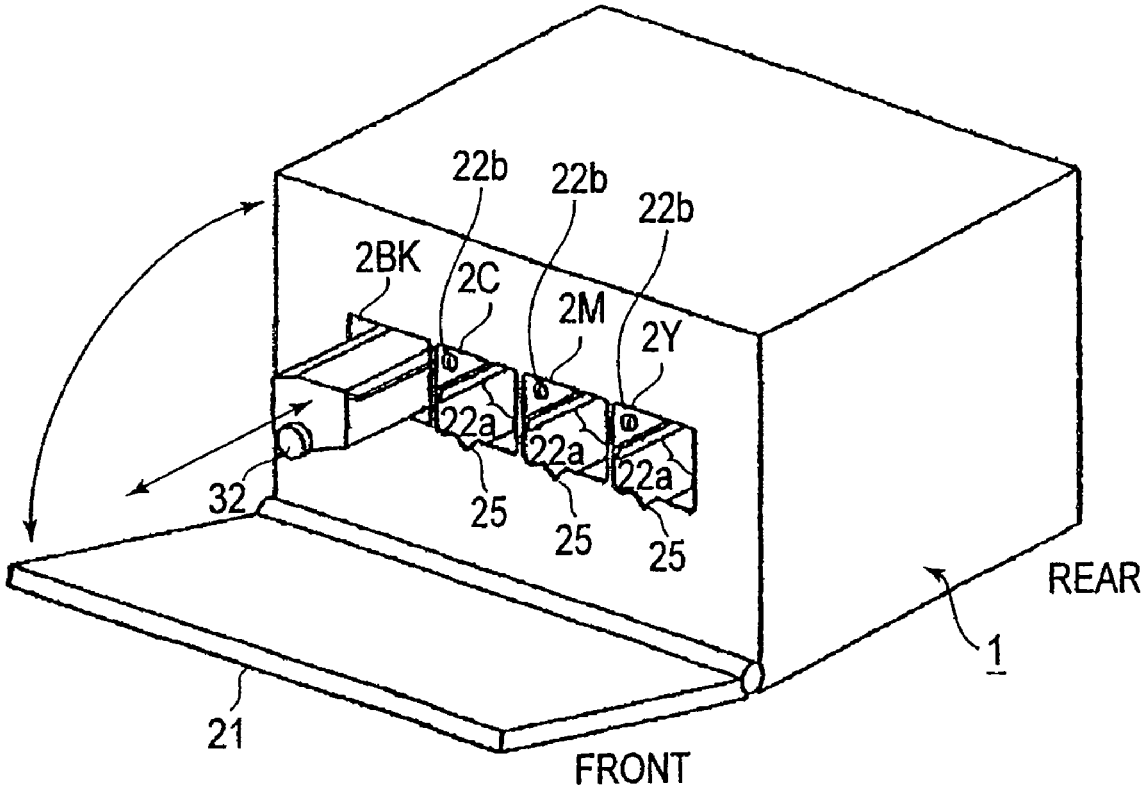
FIG. 3 is a schematic perspective view of the image forming apparatus, the cover (front door) of which is open.

Referring to FIG. 3, the apparatus main assembly 1 is provided with a cover 21 (hinged cover), which can be opened or closed relative to the apparatus main assembly 1 by being rotated about a hinge portion 21*a* located at the bottom front of the apparatus main assembly 1. As the cover 21 is opened, the four cartridge compartments, that is, the first to fourth cartridge compartments 2Y, 2M, 2C, and 2Bk, are exposed. Each of the cartridge compartments is provided with a pair of cartridge guides 22*a*, which are on the inward surfaces of the lateral walls of the cartridge compartment, extending rearward from the front of the apparatus main assembly 1. Also, each cartridge compartment is provided with a pair of cylindrical cartridge guides 22*b*, which project from the portions of the inward surface of the lateral walls of the cartridge compartment, and which are on the front side of the apparatus main assembly 1 and above the cartridge guides 22*a*, one for one. On the other hand, the cartridge frame 31 is provided with a pair of guiding portions 33*a*, which project from the end surfaces of the frame 31, one for one. The pair of the guiding portions 33*a* are engaged with the pair of the abovementioned cartridge guides 22*b* to be guided thereby to guide the cartridge 3. In this embodiment, the guiding portions 33*a* of the cartridge frame 31 are in the form of a cylindrical boss, and project from the lateral surfaces of the cartridge frame 31, in the direction intersecting the lengthwise direction of the cartridge 3. The guiding portions 33*b* of the cartridge frame 31 are in the form of a rib, and project from the lateral surfaces of the cartridge frame 31, in the aforementioned intersectional direction. The guiding portions 33*b* extend parallel to the axial line of the photosensitive drum 4 in the apparatus main assembly 1.

An operator is to insert the cartridge 3 into the apparatus main assembly 1, from the lengthwise rear end of the cartridge 3 (the downstream end in terms of the cartridge insertion direction), with its guiding portions 33*a* engaged with and on the cartridge guides 22*a*, one for one. After inserting the cartridge 3 a certain distance, the operator is to engage the guiding portion 33*b* with the cartridge guides 22*b*, one for one, and then push the cartridge 3 deeper into the apparatus main assembly 1 in the direction parallel to the abovementioned axial line of the photosensitive drum 4.

In this embodiment, the apparatus main assembly 1 is provided with such a mechanism that keeps the primary transfer rollers 12Y, 12M, 12C, and 12Bk separated from the corresponding photosensitive drums 4 while the apparatus main assembly 1 is not in operation. Thus, when the cartridge 3 is mounted into, or removed from, the apparatus main assembly 1, a predetermined amount of a gap is always maintained between the transfer belt 9 and each cartridge 3. With the provision of this mechanism, the transfer belt 9 is prevented from being damaged when the cartridge 3 is mounted or dismounted. When the apparatus main assembly 1 is in operation, the above-described mechanism for keeping the primary transfer rollers 12Y, 12M, 13C, and 12Bk separated from the transfer belt 9 is kept deactivated, so that the primary transfer rollers are kept pressed against the corresponding photosensitive drums 4 with the transfer belt 9 between the primary transfer rollers and the corresponding photosensitive drums 4 (FIG. 1).

Figure 4:
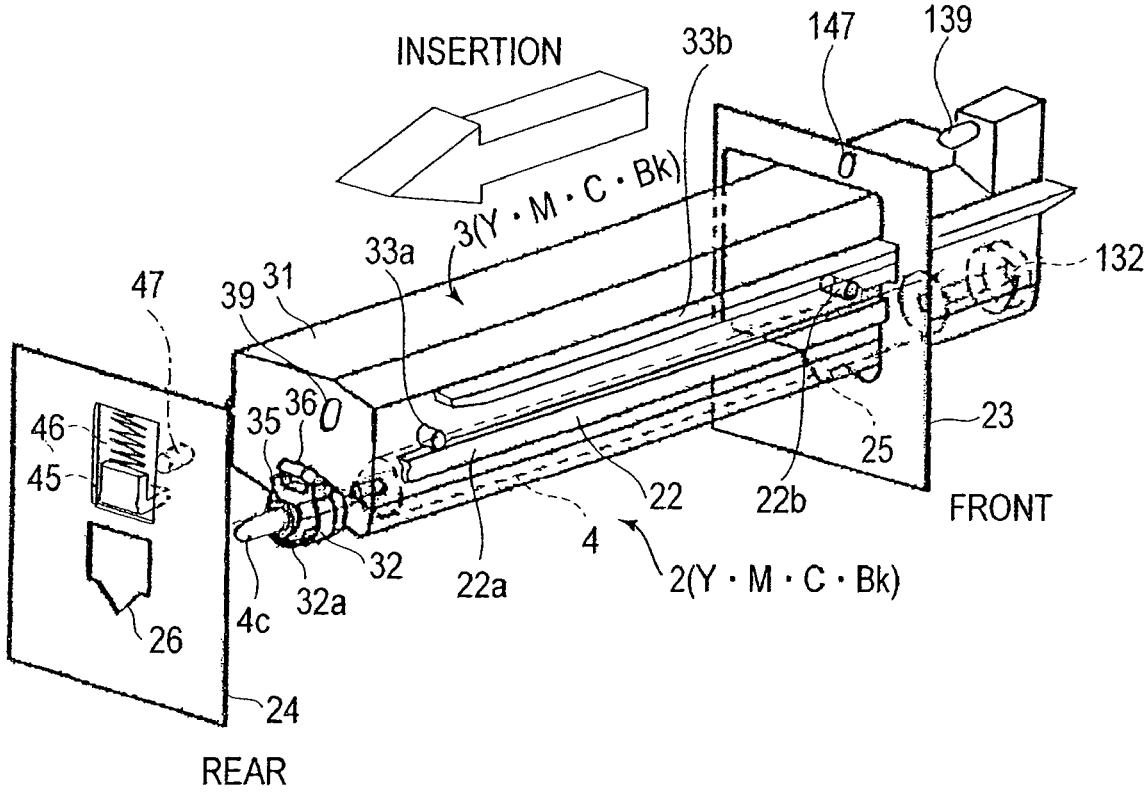
FIG. 4 is a schematic drawing for illustrating, from the downstream side in terms of the direction in which the cartridge is to be mounted, how the cartridge is inserted into the main assembly of the image forming apparatus.

FIG. 4 is a perspective drawing, which shows how the cartridge 3 is inserted into the apparatus main assembly 1, in the direction parallel to the axial line of the photosensitive drum 4. FIG. 4 is a drawing of the cartridge 3, as seen from the downstream side in terms of the direction in which the cartridge 3 is mounted into the apparatus main assembly 1. Each cartridge compartment 2 (Y, M, C, and Bk) is provided with a pair of lateral plates, that is, a lateral plate 23 on the front side (the upstream side in terms of the cartridge insertion direction) and a lateral plate 24 on the rear side (the downstream side in terms of the cartridge insertion direction). The lateral plates 23 and 24 are provided with cartridge supporting portions 25 and 26, respectively, which are in the form of a V-shaped recess.

Each of the abovementioned pair of lateral plates 23 and 24 is also provided with a positioning portion (unshown) for precisely positioning the scanner unit (8Y, 8M, 8C, and 8Bk), which corresponds in position to the cartridge 3 (Y, M, C, and Bk). The position of the scanner unit positioning portion corresponds to the cartridge supporting portion 25 (26). Therefore, the error in the positional relationship between the photosensitive drum 4 of each cartridge 3 (Y, M, C, and Bk) and the corresponding scanner unit (8Y, 8M, 8C, and 8Bk) is minimized.

Above the cartridge supporting portion 26, that is, the cartridge supporting portion on the downstream side in terms of the cartridge mounting direction, is provided a cartridge pressing means 45, the structure and operation of which will be described later in detail.

Figure 5:
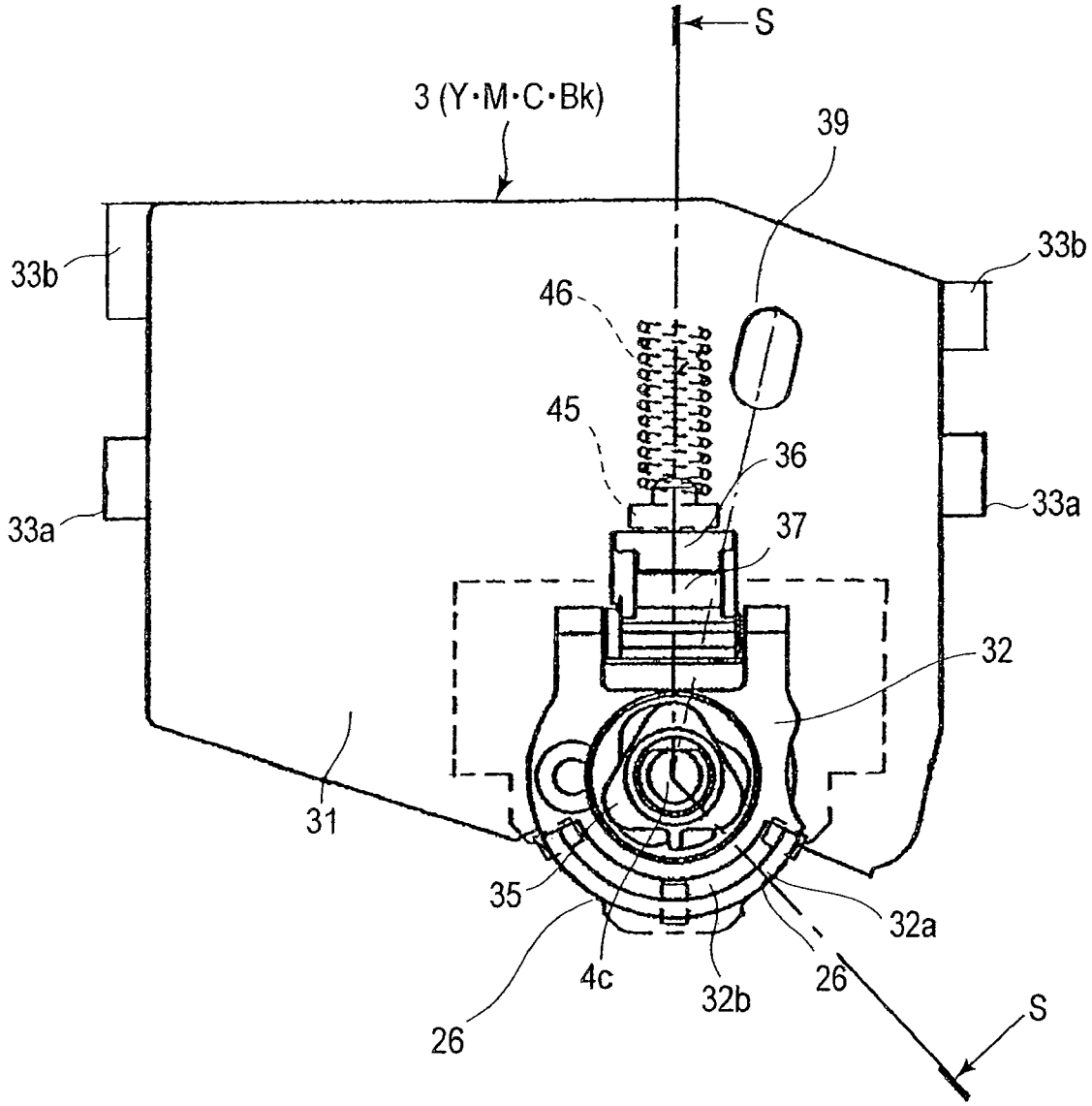
FIG. 5 is a side view of the process cartridge, as seen from the downstream side in terms of the process cartridge mounting direction.
Figure 6:
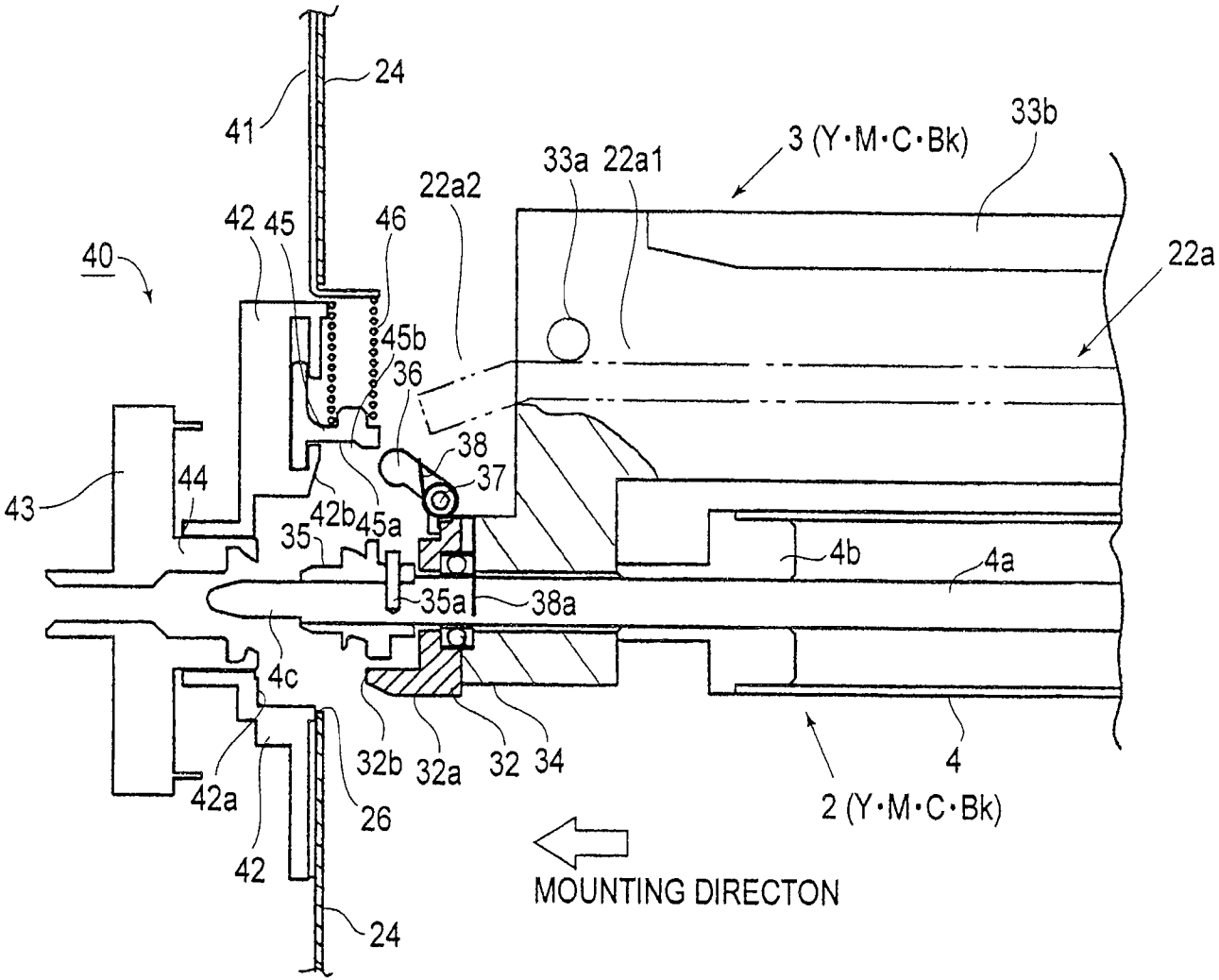
FIG. 6 is a schematic drawing (No. 1) for illustrating the process of inserting the process cartridge.

FIG. 5 is a side view of the cartridge 3, as seen from the downstream side in terms of the cartridge mounting direction, and FIG. 6 is a sectional view of the downstream end portion of the cartridge 3 in terms of the cartridge mounting direction. As described before, the lengthwise ends of the shaft 4*a* of the photosensitive drum 4 are rotatably supported by a pair of bearing members 32 and 132 located at the lengthwise ends of the cartridge frame 31, respectively. Each of the bearings 32 and 132 comprises a housing, and ball bearings 34 pressed into the housing, or inserted when the housing was molded. The housing of each of the bearing members 32 and 132 is precisely processed in terms of the relationship between the external circumference and the internal circumference of the housing. Instead of employing the ball bearings, an oil-impregnated sintered bushing or the like may be employed. As for the housing, it may be formed of a metallic substance, in consideration of the changes in component measurement that occur due to thermal contraction caused by ambient temperature, shaving, and the like.

The photosensitive drum 4 is in the form of a hollow pipe, and is supported at each of its lengthwise ends, by the shaft 4*a*, with the interposition of the flange 4*b* between the photosensitive drum 4 proper and shaft 4*a*. Thus, as the shaft 4*a* is rotationally driven, the photosensitive drum 4 rotates with the shaft 4*a*.

The downstream end portion 4*c* of the shaft 4*a*, in terms of the cartridge mounting direction, extends outward of the frame 31 from the bearing 32, and a driving force transmission male coupling 35 (in the form of a triangular spiral column, for example) is solidly attached to the end portion 4*c* with the use of a fastener pin 35*a*.

To the bearing member 32, an arm 36 as a movable member is attached so that the arm 36 is allowed to pivot about a rotational axle 37 in the direction parallel to the cartridge insertion direction. The rotational axle 37 is fitted with a coil spring 38, which keeps the arm 36 pressured so that when the cartridge 3 is out of the apparatus main assembly 1 (when arm 36 is under no pressure), the arm 36 tilts downstream (to a first position) in terms of the direction in which the cartridge 3 is mounted. Further, the bearing member 32 is provided with a rotation stopper (unshown) that keeps the arm 36 tilted at an angle of roughly 70° relative to the drum shaft 4*a*, when the cartridge 3 is out of the apparatus main assembly 1. In other words, when the arm 36 is free from pressure, the arm 36 remains in the first position (FIG. 6), in which it remains tilted at the predetermined angle so that the aforementioned end portion extends downstream as described above.

Referring to FIGS. 2, 4, and 5, the cartridge 3 is provided with an elongated hole 39 and a supporting shaft 139, which function to prevent the cartridge 3 from rotating after the engagement of the bearing members 32 and 132 into the cartridge supporting portions 25 and 26, respectively. More specifically, as the cartridge 3 is mounted into the apparatus main assembly 1, the supporting shaft 47, with which the rear lateral plate 24 is provided, engages into the elongated hole 39, and the supporting shaft 139 engages into the elongated hole 147, with which the front lateral plate 23 is provided. The direction of the elongation of the elongated holes 39 and 147 is roughly parallel to the direction in which the cartridge pressing means 45 keeps the cartridge 3 pressed. In other words, the reason the elongated holes 39 and 147 are elongated in the above-described direction is for allowing the cartridge 3 to move in the direction in which the cartridge pressing means 45 presses the cartridge 3.

In this embodiment, the arm 36 is kept pressured by the resiliency of the coil spring 38 so that the arm 36 is tilted downstream. However, for the purpose of reducing component count, a structural arrangement may be made, instead of employing a spring or the like, so that the weight of the arm 36 itself functions to keep the arm 36 tilted downstream, in terms of the direction in which the process cartridge is mounted.

Referring to FIG. 6, the apparatus main assembly 1 is provided with the driving force transmitting mechanism 40 for transmitting a driving force to the photosensitive drum 4. The driving force transmitting mechanism 40 is located on the outward side of the rear lateral plate 24 (the opposite side of the apparatus main assembly 1 from side from which cartridge 3 is mounted), in alignment with the supporting portion 26.

The driving force transmitting mechanism 40 on the main assembly side has: a substructural plate 41; a bearing member 42 solidly attached to the outward surface of the substructural plate 41; a driving gear 43 rotationally borne by the bearing member 42; a driving force transmitting female coupling 44, which is the inward portion of the driving gear 43, in terms of the radius direction thereof; the movable pressing member 45 as a cartridge pressing means movably attached to the inward surface of the bearing member 42 so that it is allowed to vertically slide; and a compression coil spring 46 which keeps the pressing member 45 pressured downward. The female coupling 44 engages with the male coupling portion 35, which will be described later. Further, the female coupling portion 44 transmits the driving force for rotating the photosensitive drum 4, from the apparatus main assembly 1 to the male coupling portion 35. The cartridge pressing member 45 is movably attached to the surface of the bearing member 42 so that it is allowed to vertically slide. The driving gear 43 is borne by the bearing member 42, with the presence of a predetermined gap, in order to allow the driving gear 43 to slide relative to the downstream end portion 4*c* of the shaft 4*a* of the photosensitive drum, so that the driving gear 43 is precisely positioned relative to the cartridge 3 (photosensitive drum 4).

The driving force transmitting mechanism 40 on the main assembly side is fixed to the rear lateral plate 24; the substructural plate 41 of the mechanism 40 is solidly attached to the rear lateral plate 24 with the use of screws or the like.

Next, referring to FIGS. 6-9, the process of mounting the cartridge 3 into the apparatus main assembly 1 will be described. Figures are sectional views taken along a line S-S in FIG. 5.

(a) Referring to FIG. 3, an operator exposes the cartridge compartments 2Y, 2M, 2C, and 2Bk by opening the aforementioned cover 21. Then, the operator inserts each cartridge 3 into the corresponding cartridge compartment 2 from the rear end of the cartridge 3 in terms of the cartridge insertion direction, so that the ribs 33*a* of the cartridge 3, as the cartridge guiding portions, are engaged into the cartridge guides 22*a* of the apparatus main assembly 1, one for one, and so that the ribs 33*b* are engaged with the cartridge guides 22*b*, one for one. Then, the cartridge 3 is inserted further in the direction parallel to the axial line of the photosensitive drum 4.

Figure 7:
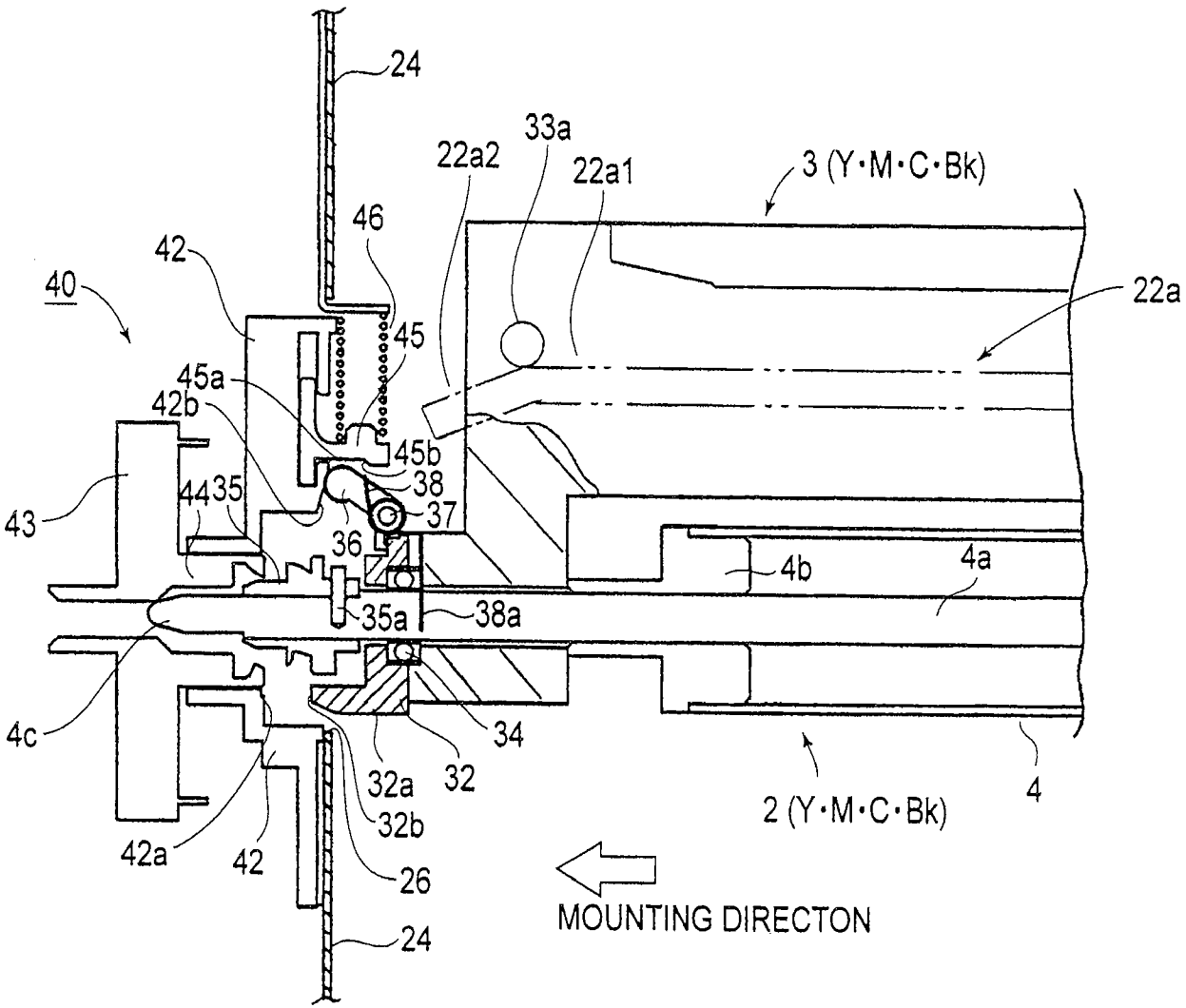
FIG. 7 is a schematic drawing (No. 2) for illustrating the process of inserting the process cartridge.
Figure 8:
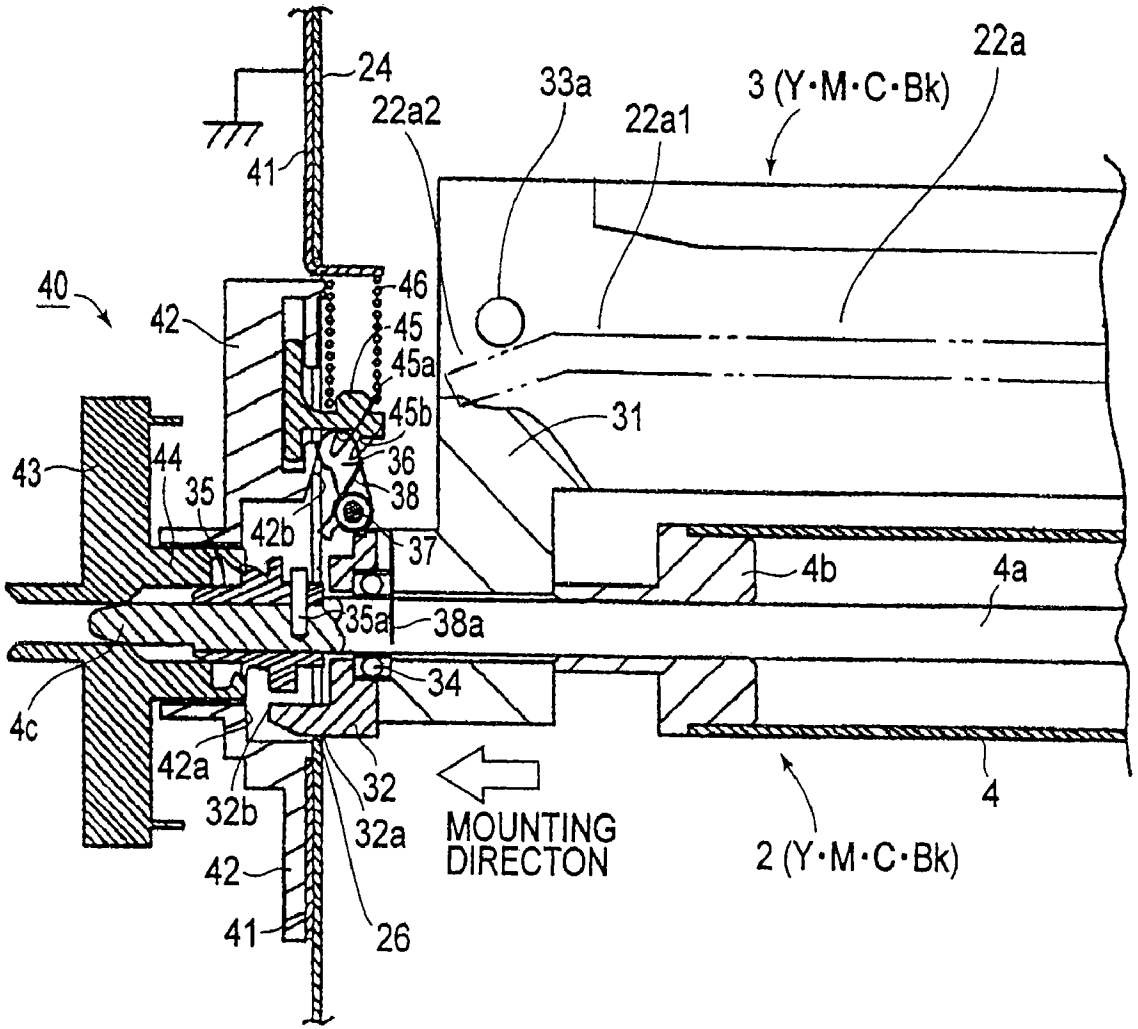
FIG. 8 is a schematic drawing (No. 3) for illustrating the process of inserting the process cartridge.

(b) Referring to FIGS. 6 and 7, as the cartridge 3 is inserted further into the apparatus main assembly 1, the bearing member 32 enters the cartridge supporting portion 26, with the portion 32*a* of the bearing member 32, by which the bearing member 32 is to be supported by the cartridge supporting portion 26, not contacting the cartridge supporting portion 26. Therefore, during this step, no frictional resistance is generated between the cartridge supporting portion 26 and bearing member 32, because the ribs 33*a* of the cartridge 3 are engaged with the flat portions 22*a*1 of the cartridge guides 22*a*, which are parallel to the cartridge insertion direction. Next, referring to FIG. 8, as the cartridge 3 is further inserted into the apparatus main assembly 1, the portion 32*a* comes into contact with the cartridge supporting portion 26, because the ribs 33*a* of the cartridge 3 are moved onto the downwardly inclined portion 22*a*2 of the cartridge guides 22, which causes the cartridge 3 to advance diagonally downward.

Figure 9:
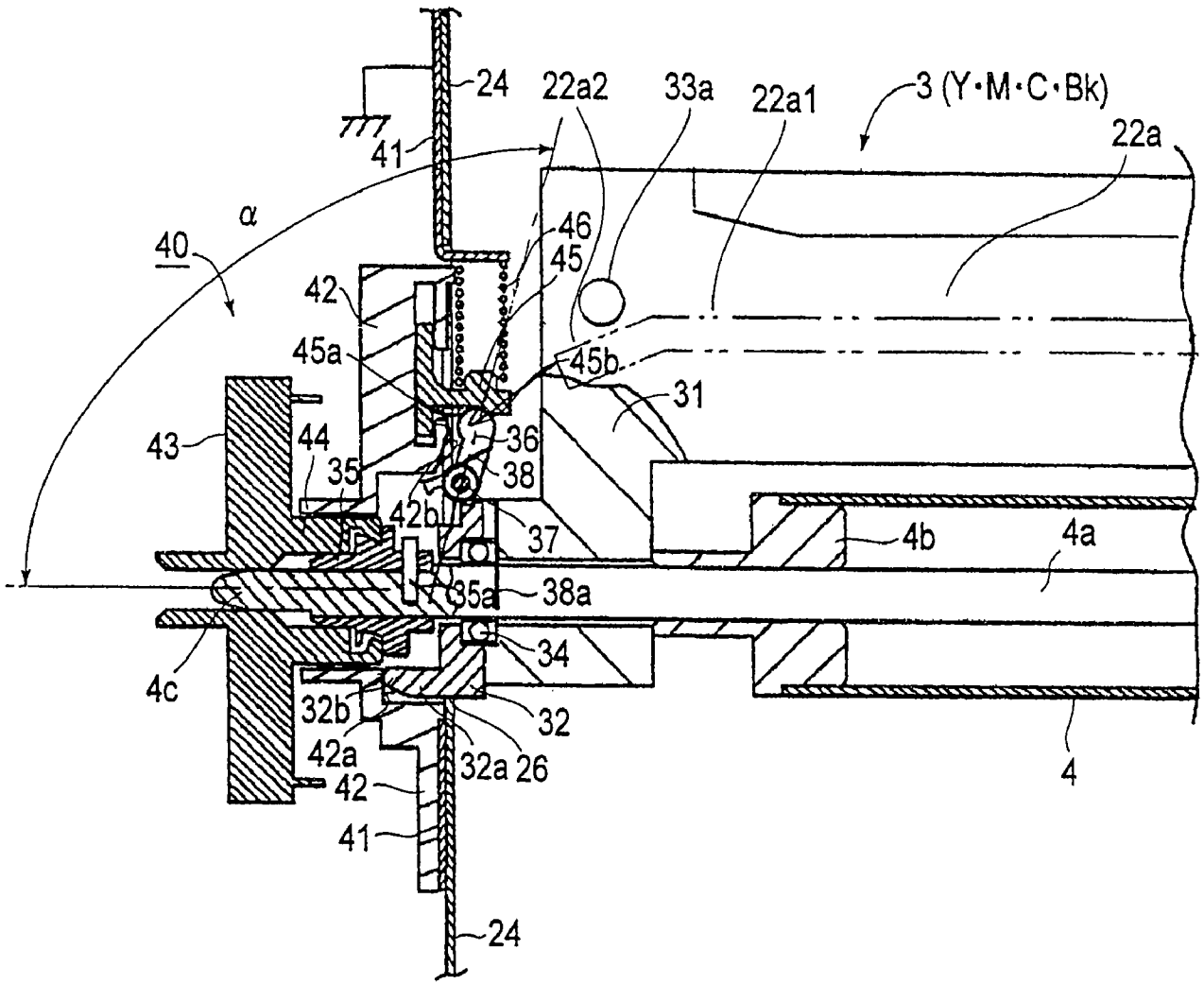
FIG. 9 is a schematic drawing (No. 4) for illustrating the process of inserting the process cartridge.

(c) Next, referring to FIG. 9, as the cartridge 3 is inserted further, the contact between the cartridge 3 and the apparatus main assembly 1 is only between the portion 32*a* of the bearing member 32 of the cartridge 3 and the cartridge supporting portion 26; the ribs 33*a* become disengaged from the cartridge guides 22*a*. In other words, the cartridge 3 is precisely positioned relative to the apparatus main assembly 1 in terms of the radial direction of the photosensitive drum 4. Further, when the cartridge 3 is in the state shown in FIG. 9, the leading end surface 32*b* of the portion 32*a* has come into the inward surface 42*a* of the bearing member 32 of the apparatus main assembly 1, in terms of the axial line of the bearing member 32. This contact between the leading end surface 32*b* and the inward surface 42*a* prevents the further insertion of the cartridge 3 into the apparatus main assembly 1; in other words, the cartridge 3 is precisely positioned relative to the apparatus main assembly 1, being prevented from moving from position, in terms of the thrust direction of the photosensitive drum 4. During this step, the driving gear 43 becomes engaged with the downstream end 4*c* of the drum shaft 4*a*, being thereby precisely positioned.

Further, the male coupling portion 35 on the cartridge side sufficiently enters the female coupling 44. In other words, the male coupling portion 35 becomes coupled with the female coupling portion 44 (FIG. 9). Thus, as the driving gear 43 is driven by the mechanical power source (unshown) on the man assembly side, the driving force from the power source is transmitted to the shaft 4*a*, thereby rotationally driving the photosensitive drum 4.

Further, the electrical contacts (unshown) on the cartridge side are placed in contact with the electrical contacts (unshown) on the main assembly side, making it possible for bias to be applied to the charging means 5 and development roller 6*a* from the electrical power source (unshown) on the main assembly side.

In this embodiment, the contact portion for precisely positioning the cartridge 3 relative to the apparatus main assembly 1, in terms of the thrust direction, as the cartridge 3 is mounted into the apparatus main assembly 1, is the leading end surface 32*b* of the portion 32*a* of the bearing member 32, by which the bearing member 32 is supported by the cartridge supporting portion 26. The employment of this structural arrangement improves the preciseness with which the cartridge 3 is positioned relative to the apparatus main assembly 1. However, the contact portion for positioning the cartridge 3 does not need to be a part of the bearing member 32; it may be a part of a member other than the bearing member 32, or may be provided as an independent member.

(e) Next, the movement of the arm 36 will be described.

Referring to FIG. 7, as the cartridge 3 is inserted further from the position shown in FIG. 6, first, the bearing member 32 enters the cartridge supporting portion 26, with no contact between the portion 32*a*, by which the bearing 32 is to be supported by the cartridge supporting member 26, and the cartridge supporting portion 26. Then, the end of the arm 36 in the first position comes into contact with the inward surface 42*b* of the bearing member 42, in terms of the axial direction of the bearing member 32, as described above. The moment the end of the arm 36 comes into contact with the inward surface 42*b*, there is the cartridge pressing member 45 above the arm 36, with a clearance of several millimeters between the end of the arm 36 and the cartridge pressing surface 45*a*, or the downwardly facing surface, of the cartridge pressing member 45.

Then, as the cartridge 3 is further inserted, the end of the arm 36 is pressed by the surface 42*b*, causing the arm 36 to begin rotating about the rotational axle 37 in the direction opposite to the cartridge insertion direction against the resiliency of the coil spring 38. As a result, the end of the arm 36 comes into contact with the pressing surface 45*a* of the pressing member 45. At this point in the cartridge mounting process, the first ribs 33*a* of the cartridge 3, which is guided by the cartridge guide 22 of the apparatus main assembly 1, become engaged with the slanted portions 22*a* of the cartridge guides 22, beginning to make the downstream end portion of the cartridge 3, in terms of the cartridge insertion direction, progress diagonally downward, and the portion 32*a* of the bearing member 32 comes into contact with the cartridge supporting portion 26. As for the arm 36, it is pressed by the pressing member 45 in the direction to press the portion 32*a* upon the cartridge supporting member 26 (the direction intersecting the axial line of photosensitive drum 4).

As the cartridge 3 is inserted even further, the end of the arm 36 pushes up the pressing member 45 against the resiliency of the spring 46. As a result, the angle $\alpha$ between the axial line of the photosensitive drum 4 and a line connecting the rotational axis of the arm 36 and the end of the arm 36 becomes greater than 90°. When the angle $\alpha$ is no more than 90°, the moment the pressing surface 45*a* of the pressing member 45 gives to the arm 36 functions in the direction to reduce the angle $\alpha$, whereas when the angle $\alpha$ is greater than 90°, the moment acts in the opposite direction, or the direction to increase the angle $\alpha$. The moment when the angle $\alpha$ exceeds 90°, the arm 36 comes into contact with, being thereby caught by, the regulating portion 45*b* of the abovementioned pressing surface 45*a*, being thereby prevented by the regulating portion 45*b* from rotating any further. The position in which the arm 36 is stopped by the regulating portion 45*b* is the second position, and the arm 36 is kept in this position by the regulating portion 45*b*. This structural arrangement is effective to yield a feel of clicking while an operator is mounting the cartridge 3 into the apparatus main assembly 1. Incidentally, the pressing surface 45*a* may be modified in shape to emphasize the feel of clicking.

When the arm 36 is in the second position, not only is it under the force which presses portion 32*a* of the bearing member 32 upon the cartridge supporting portion 26, but also under the force which presses the cartridge 3 downstream in terms of the cartridge insertion direction. As the cartridge 3 is inserted further, the leading end surface 32*b* of the portion 32*a* of the bearing member 32 comes into contact with the aforementioned inward surface 42*a*, thereby preventing the cartridge 3 from being further inserted. In other words, the inserted cartridge 3 is precisely positioned relative to the apparatus main assembly 1 in terms of the thrust direction. In other words, the force to which the arm 36 is subjected, and which presses the arm 36 downstream in terms of cartridge insertion direction, also contributes to the positioning of the cartridge 3 in terms of the thrust direction. Further, the male coupling 35 sufficiently enters the female coupling 44, and the male coupling 35 becomes coupled with the female coupling 45.

During this step, the pressure which the arm 36 received from the pressing surface 45*a* is transmitted by the arm 36 to the bearing member 32, causing thereby the bearing member 32 to be pressed on the cartridge supporting portion 26. As a result, the photosensitive drum 4 is precisely positioned relative to the apparatus main assembly 1 in terms of the radial direction of the photosensitive drum 4, and the cartridge 3 is kept in this position. In this embodiment, the arm 36 is rotatably attached to the bearing member 32. However, as long as the arm 36 can be made to function as described above, the arm 36 may be movably attached in a manner other than a rotatable manner.

Since the bearing member 32 is precisely processed in terms of the relationship between the external and internal circumferences of its housing, the error in the position of the photosensitive drum 4 relative to the cartridge supporting portion 26 is minimized. Further, not only is the arm 36 attached to the bearing member 32, but also, the portion 32*a*, by which the cartridge 3 is supported by the cartridge supporting portion 26 is a part of the bearing member 32. Therefore, the cartridge frame 31 is prevented from being warped by the pressure applied thereto. Further, in this embodiment, the frame 31 is formed of resin (polyethylene, or the like). However, because of the employment of the above-described structural arrangement, even though there is a certain distance between the arm 36 and the portion 32*a*, when the frame 31 is subjected to external force, it is prevented from elastically vibrating. In other words, the above-described structure of the bearing member 32 is effective even from the standpoint of vibration damping.

In this embodiment, the primary transfer roller (12Y, 12M, 12C, and 12Bk) applies an upward pressure of roughly 2 kgf (19.6N) to the photosensitive drum 4. On the other hand, the amount of downward pressure applied to the cartridge 3 by the abovementioned pressing member 45 must be large enough to overcome the abovementioned upward pressure applied to the photosensitive drum 4 by the primary transfer roller 12. Therefore, the former is set to a value estimated to be twice the latter. In other words, assuming that the photosensitive drum 4 is pressed downward at both ends in terms of the axial direction by the same amount of force, the amount of downward force applied to the downstream end of the cartridge 3 in terms of the cartridge insertion direction by the pressing member 45 is set to 2 kgf.

Figure 10:
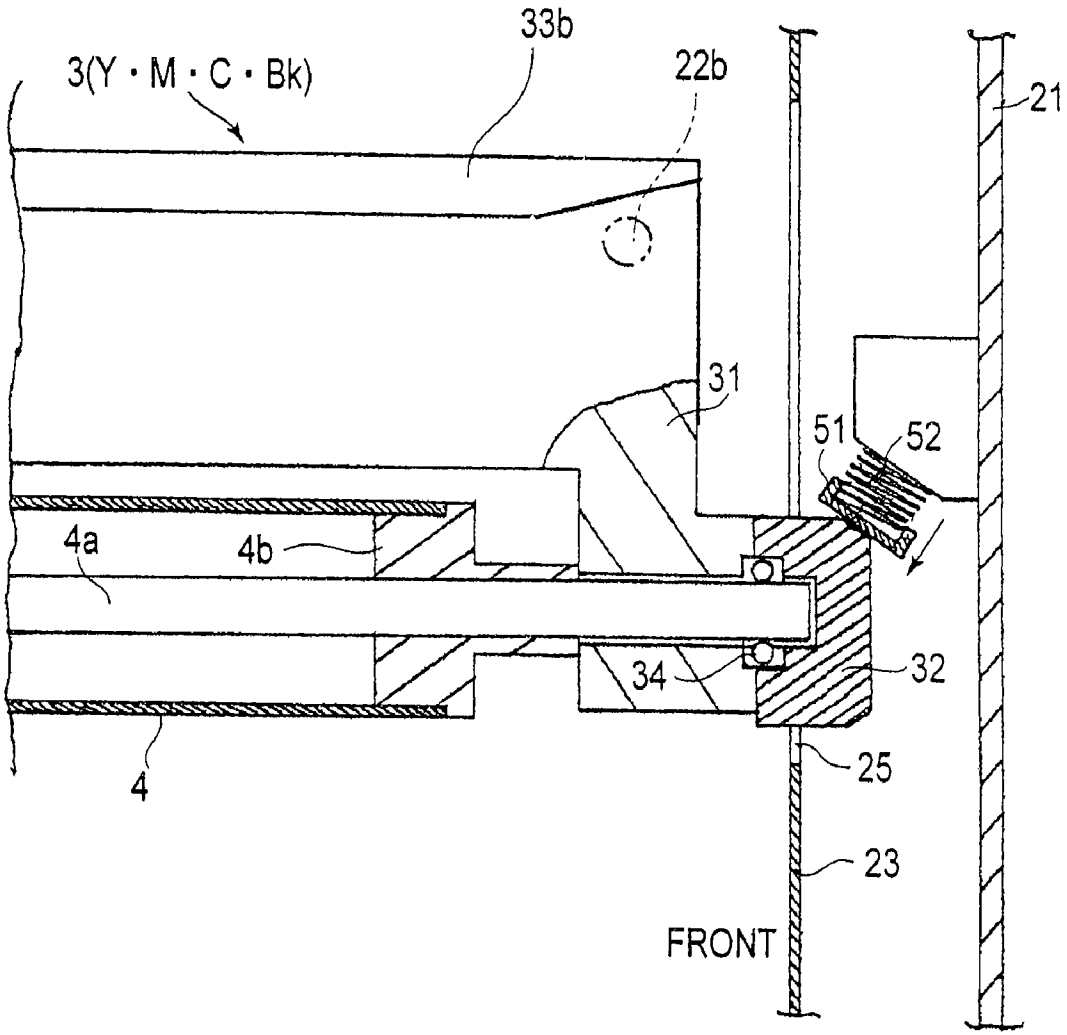
FIG. 10 is a drawing for illustrating the positioning and fixation of the drum bearing member, on the upstream side in terms of the process cartridge mounting direction.

(f) As described above, after the successful completion of the process of mounting the cartridge 3 into the cartridge compartment 2 (FIG. 9), the bottom surface of the bearing member 32, or the bearing member on the upstream side in terms of the cartridge insertion direction, is at the same level as the cartridge supporting portion 25 of the front lateral plate 23 of the apparatus main assembly 1. In this embodiment, as the cover 21 is closed, the pressing member 51 attached to the inward surface of the cover 21 comes into contact with the bearing member 132, and then, as the cover 21 is closed further, the bearing member 132 is pressed upon the cartridge supporting portion 25 of the front lateral plate 23 by the resiliency of the spring 52, which presses the pressing member 51. As a result, the bearing member 132 is precisely positioned relative to the supporting portion 25, as shown in FIG. 10. When the cartridge 3 is in this state, the portion 32*b* of the cartridge 3, by which the cartridge 3 is guided, and the cartridge guide 22*b* of the apparatus main assembly 1, are not in contact with each other.

In this embodiment, the arm 36, the rotational axle 37, the coil spring 38, the pressing member 45, the compression coil spring 46, and the substructural plate 41 are formed of metallic substances or electrically conductive nonmetallic substances. Thus, after the successful mounting of the cartridge 3 into the apparatus main assembly 1 (FIG. 9), the photosensitive drum 4 is grounded to the apparatus main assembly 1 through the arm 36. More specifically, one end 38*a* of the coil spring 38 is extended so that it remains elastically in contact with the shaft 4*a* of the photosensitive drum 4. Also after the successful mounting of the cartridge 3 into the apparatus main assembly 1 (FIG. 9), the shaft 4*a* of the photosensitive drum 4 in the cartridge 3 is grounded to the apparatus main assembly 1 through the route of the coil spring 38-arm 36-pressing member 45-compression coil spring 46-substructural plate 41-rear lateral plate 24 (metallic). In other words, the photosensitive drum 4 is grounded by creating an electrical path between the photosensitive drum 4 and apparatus main assembly 1.

(g) The process of removing the cartridge 3 from the apparatus main assembly 1 is the reverse of the above-described process of mounting the cartridge 3 into the apparatus main assembly 1. As the cartridge 3 is removed from the apparatus main assembly 1, the arm 36 is returned to the first position by the resiliency of the coil spring 38.

(3) Verification of Force Required to Insert Cartridge

As for the structural arrangement for pressing the cartridge 3 upon the cartridge supporting portion 24 in coordination with the insertion of the cartridge 3 into the apparatus main assembly 1, the following structural arrangement may be employed in place of the structural arrangement in this embodiment, which employs the arm 36.

That is, the pressing surface of the apparatus main assembly 1 is provided with a slanted portion, and the cartridge 3 is provided with a slanted surface, instead of the arm 36, which is positioned to oppose the abovementioned slanted portion of the pressing surface of the apparatus main assembly 1. Thus, as the cartridge 3 is inserted, the slanted surface of the cartridge 3 presses upward the slanted portion of the pressing surface of the apparatus main assembly 1, while sliding against the slanted portion of the pressing surface of the apparatus main assembly 1. However, from the standpoint of which is smaller in the amount of force required to insert the cartridge 3, the structural arrangement which employs the above-described rotational arm 36 is superior. This will be verified next.

Figure 11:
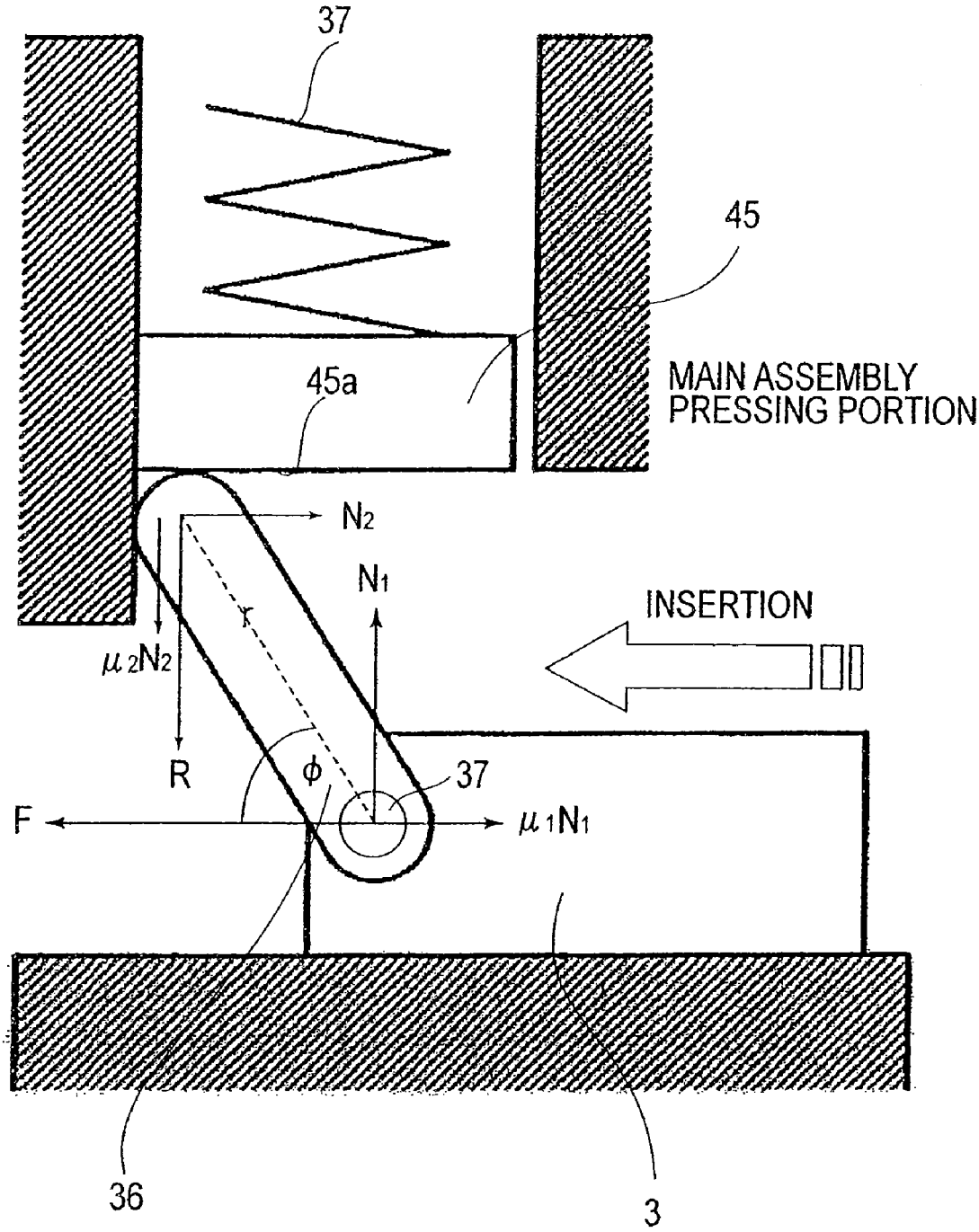
FIG. 11 is a schematic drawing of the dynamic model reflecting the structural arrangement in accordance with the present invention, effective to reduce the amount of force required to insert the process cartridge into the main assembly of an image forming apparatus.

(a) First, a dynamic model shown in FIG. 11 is created from the cartridge pressing structure in this embodiment. In this model:

F: amount of force required to insert cartridge 3 into apparatus main assembly 1;

R: amount of downward pressure;

$\phi$: arm angle at the time of contact between arm and contact portion on main assembly side;

N1: reactive force from the pressing member guide, perpendicular to guide surface;

N2: reactive force from the pressing member, perpendicular to downwardly facing surface of pressing member;

$\mu$1: coefficient of dynamic friction of cartridge guide;

$\mu$2: coefficient of dynamic friction of pressing member guide; and r: length of arm.

Here, F stands for the amount of force applied to the point of the cartridge 3 by which the cartridge 3 is pressed for insertion. In reality, the amount of force required to insert the cartridge 3 into the apparatus main assembly 1 is the sum of F and the amount of force necessary to overcome the friction generated by the weight of the cartridge itself.

The relationship among the forces to which the arm is subjected, in terms of the horizontal and vertical directions, when the arm is in the state shown in FIG. 11 can be expressed in the following mathematical equations:

$$F-\mu 1N1-N2=0 \quad (1); \text{ and}$$

$$R-N1-\mu 2N2=0 \quad (2)$$

As for the equilibratory relationship among the moments about the rotational axis of the arm, $$\{R+\mu 2N2)\cos\phi-N2\sin\phi\}r=0 \quad (3).$$

To deduce the ratio of F (amount of force required to insert cartridge 3 into apparatus main assembly 1) to R (reactive force from pressing member) from Equations (1), (2), and (3), $$F/R=(\mu 1\tan\phi-2\mu 1\mu 2+1)/(\tan\phi-\mu 2) \quad (4) \text{ is obtained.}$$

Figure 13:
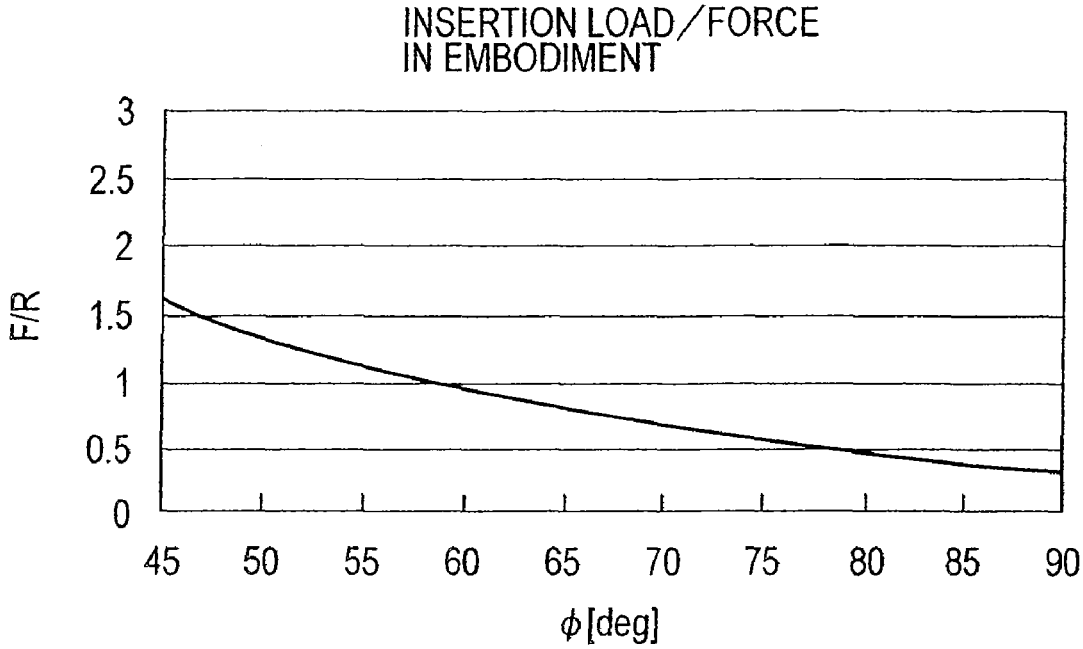
FIG. 13 is a graph (No. 1) showing the difference between the cartridge positioning structure in accordance with the present invention, and the cartridge positioning structure which is not in accordance with the present invention, in terms of the amount of force required to insert a process cartridge into the main assembly of an image forming apparatus.

The relationship between F and R when the coefficients of dynamic frictions $\mu$1 and $\mu$2 are equal to 0.3 ($\mu$1=$\mu$2=0.3) is shown in FIG. 13 ($45° \leqq \phi \leqq 90°$).

It is evident from FIG. 13 that the greater the angle $\phi$ of the arm at the moment the tip of the arm comes into contact with the pressing surface, the smaller the amount of force required to insert the cartridge 3 into the apparatus main assembly 1. When the angle $\phi$ of the arm is roughly 58°, the amount of the reactive force R equals the amount of the force required to insert the cartridge 3 (F/R=1). However, in reality, the angle can be made greater to further reduce the amount of the force required to insert the cartridge 3.

Figure 12:
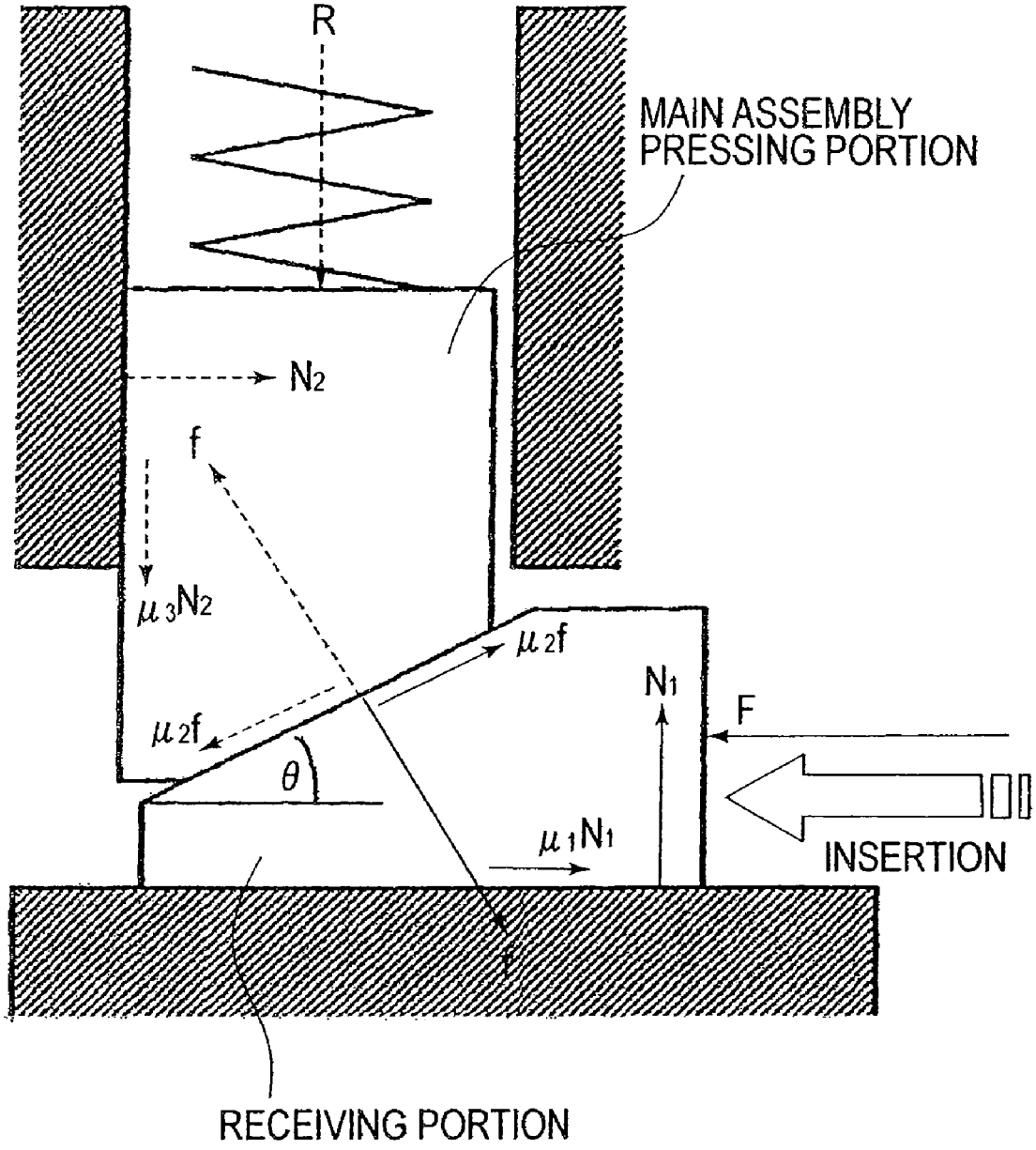
FIG. 12 is a schematic drawing of the dynamic model reflecting a comparative structural arrangement which is not in accordance with the present invention, for illustrating the difference between the structural arrangement in accordance with the present invention and that which is not in accordance with the present invention.

(b) Next, FIG. 12 shows the dynamic model reflecting (which reflects) the cartridge positioning structural arrangement, in which the cartridge pressing member of the apparatus main assembly, the pressing surface of which has the slanted portion, is pressed upward by the slanted surface of the cartridge frame. In the drawing, the arrow marks formed of a solid line stand for the force which acts on the pressure catching portions, whereas the arrow marks formed of a dotted line stand for the force which act on the pressure applying portions.

In this model:

F: amount of force required to insert the cartridge 3 into the apparatus main assembly 1;

R: amount of downward pressure;

θ: angle of the slanted surface;

N1: reactive force from the cartridge guide, perpendicular to the guide surface;

N2: reactive force from surface of the pressing member guide, perpendicular thereto;

f: reactive force perpendicular to the slanted surface;

μ1: coefficient of dynamic friction of the cartridge guide;

μ2: coefficient of dynamic friction of each of the slanted surfaces;

μ3: coefficient of dynamic friction of the pressing member guide;

Here, F stands for the amount of force applied to the portion of the cartridge 3, by which the cartridge 3 is pushed to insert the cartridge 3 into the apparatus main assembly 1, as described above. However, the actual amount of force required to insert the cartridge 3 into the apparatus main assembly 1 is the sum of F and the resistance resulting from the friction attributable to the weight of the cartridge 3 itself.

To express the equilibratory relationship among the forces to which the pressure catching portions are subjected, in terms of the horizontal and vertical directions, $$F=f\cdot\sin\theta-\mu 1N1-\mu 2f\cos\theta=0 \quad (5);\text{ and}$$

$$N1-f\cos\theta+\mu 2f\sin\theta=0 \quad (6).$$

Similarly, the equilibratory relationships, in terms of horizontal and vertical direction, among the forces to which the pressing member is subjected, are:

$$-N2+f\sin\theta+\mu 2f\cos\theta=0 \quad (7);\text{ and}$$

$$-R+f\cos\theta-\mu 2f\sin\theta-\mu 3N2=0 \quad (8).$$

To deduce the ratio of F (cartridge insertion force) to downward pressure R from the above mathematical equations (5)-(8), $$F/R=(\mu 1+\mu 2+(1-\mu 1\mu 2)\tan\theta)/(1-\mu 2\mu 3-(\mu 2+\mu 3)\tan\theta) \quad (9)\text{ is obtained.}$$

Figure 14:
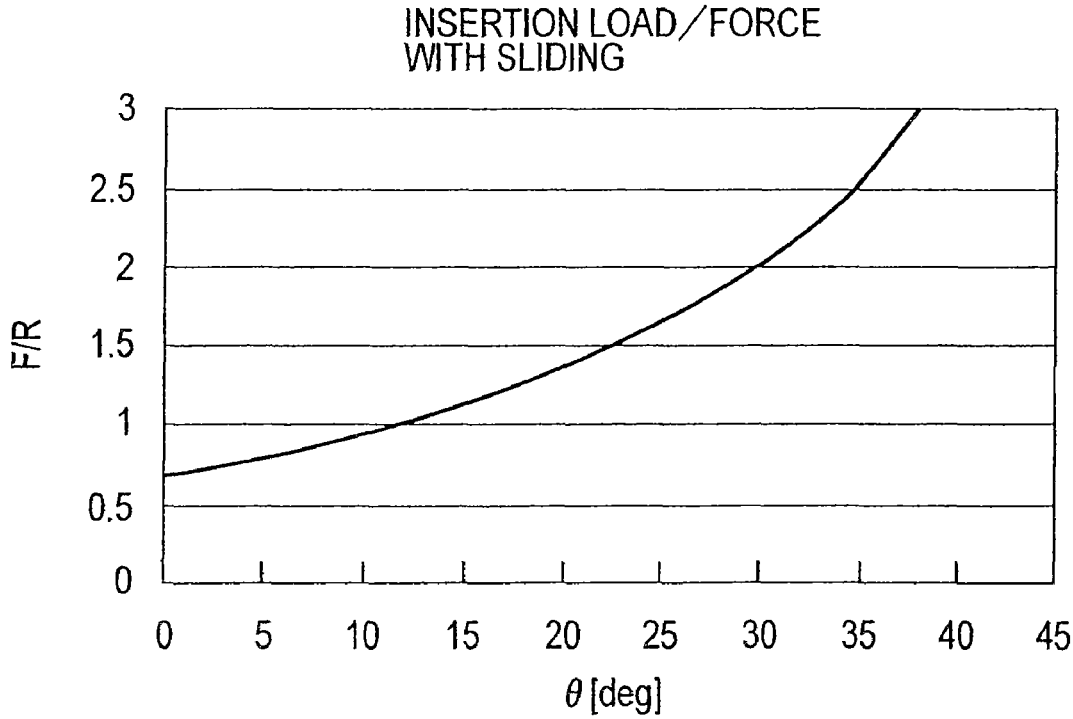
FIG. 14 is a graph (No. 2) showing the difference between the cartridge positioning structure in accordance with the present invention, and the cartridge positioning structure which is not in accordance with the present invention, in terms of the amount of force required to insert a process cartridge into the main assembly of an image forming apparatus.

FIG. 14 shows the relationship between F (cartridge insertion force) and R (downward pressure) when μ1=μ2=μ3=0.3 (0°≦θ≦45°).

It is evident from FIG. 14 that the greater the angle θ of the slanted surfaces, the greater the amount of force required to insert the cartridge 3 into the apparatus main assembly 1. When the angle θ of the slanted surfaces is roughly 12°, the amount of the downward pressure R equals the amount of the force F required to insert the cartridge 3 (F/R=1). However, the smaller the angle of the slanted surfaces, the longer the slanted surfaces in terms of the cartridge insertion direction, and accordingly, the cartridge and apparatus main assembly must be made greater in size.

Figure 15:
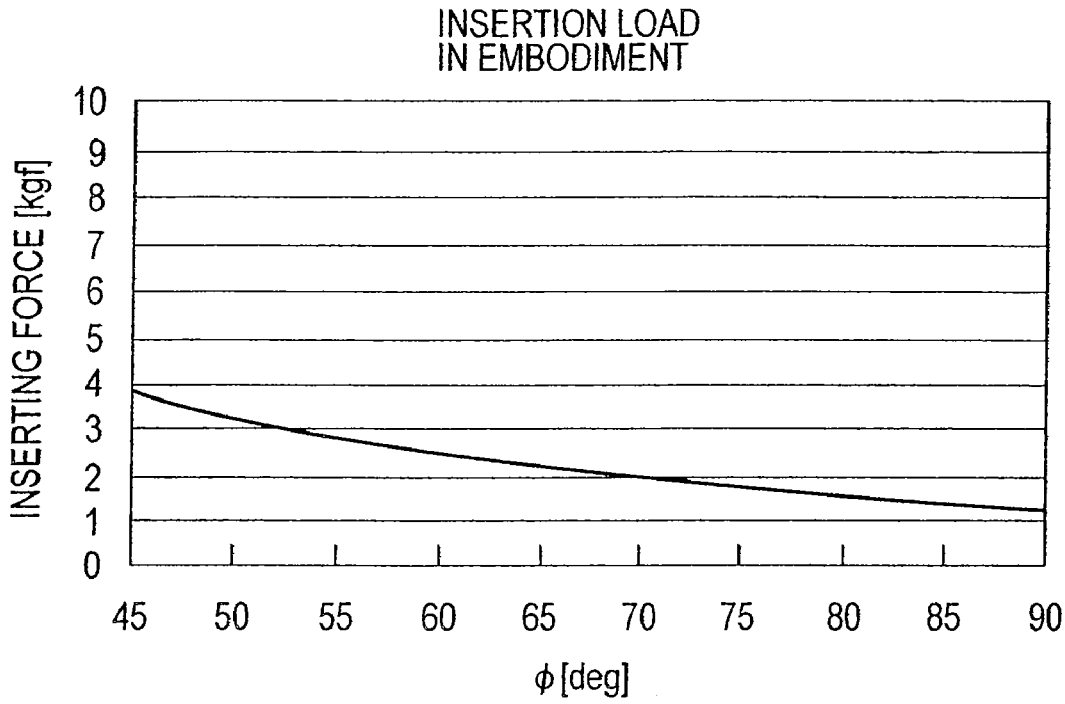
FIG. 15 is a graph (No. 3) showing the difference between the cartridge positioning structure in accordance with the present invention, and the cartridge positioning structure which is not in accordance with the present invention, in terms of the amount of force required to insert a process cartridge into the main assembly of an image forming apparatus.
Figure 16:
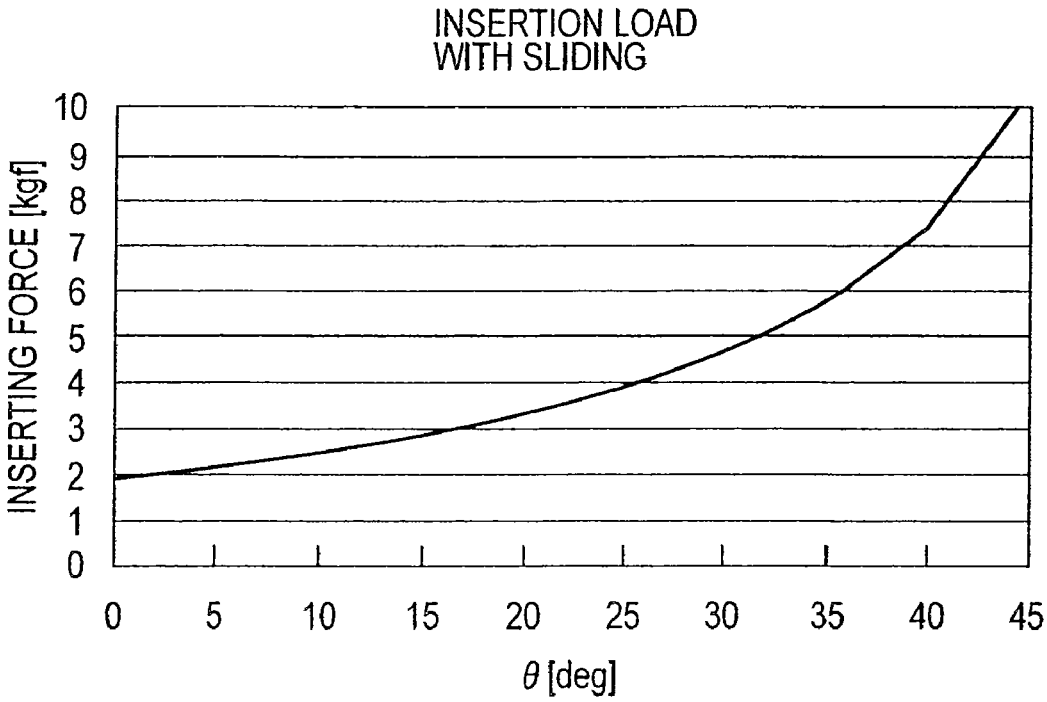
FIG. 16 is a graph (No. 4) showing the difference between the cartridge positioning structure in accordance with the present invention, and the cartridge positioning structure which is not in accordance with the present invention, in terms of the amount of force required to insert a process cartridge into the main assembly of an image forming apparatus.

(c) In reality, when estimating the amount of the cartridge insertion force, the resistance resulting from the weight of the cartridge 3 itself must be taken into consideration. FIG. 15 shows the actual amount of force required, in this embodiment, to insert the cartridge 3 into the apparatus main assembly 1 when the weight of the process cartridge was 2 kgf. In this embodiment, the downward pressure R was 2 kgf; and the coefficient of dynamic friction between the two slanted surfaces was 0.3. Further, FIG. 16 shows the actual amount of force required to insert the cartridge 3 into the apparatus main assembly 1, under the same conditions as the abovementioned ones, when the cartridge positioning structure employing the slanted surfaces was employed. Generally, the amount of force that an average operator does not mind exerting in order to insert the cartridge 3 into the apparatus main assembly 1 is said to be roughly 2 kgf. With the employment of the slanted surface structural arrangement, it is virtually impossible to achieve this target value of "no more than 2 kgf". In comparison, with the employment of the rotational arm, the value of 2 kgf can be achieved by designing the cartridge 3 and the apparatus main assembly 1 so that the arm angle will be no less than roughly 70° at the moment when the arm comes into contact with the bearing member guide.

According to this embodiment, when the cartridge 3 is inserted into the apparatus main assembly 1, the cartridge 3 is pressed upon the cartridge supporting portion 26 by the movement of the cartridge 3, causing thereby the photosensitive drum 4 to be precisely positioned relative to the apparatus main assembly 1. Further, it is possible to provide a process cartridge which is substantially smaller in the amount of force required for the insertion thereof than a process cartridge in accordance with the prior art. In addition, it is possible to realize the above-described benefits while keeping both the cartridge and image forming apparatus simple in structure. In other words, this embodiment makes it possible to provide a process cartridge and an image forming apparatus, which are simpler in structure and yet smaller in the amount of force required to insert the cartridge into the apparatus main assembly than a process cartridge and an image forming apparatus, in accordance with the prior art; this embodiment can reduce the amount of force required to mount a process cartridge into an image forming apparatus.

Embodiment 2

Next, the second embodiment of the present invention will be described. The structure of the image forming apparatus in this embodiment, as well as those of the image forming apparatuses in the third and fourth embodiment, which will be described later, are identical to that in the first embodiment shown in FIG. 1. Thus, the members in this embodiment and the embodiments thereafter, which are identical to those in the first embodiment will be given the same reference symbols, and will not be described.

Figure 17:
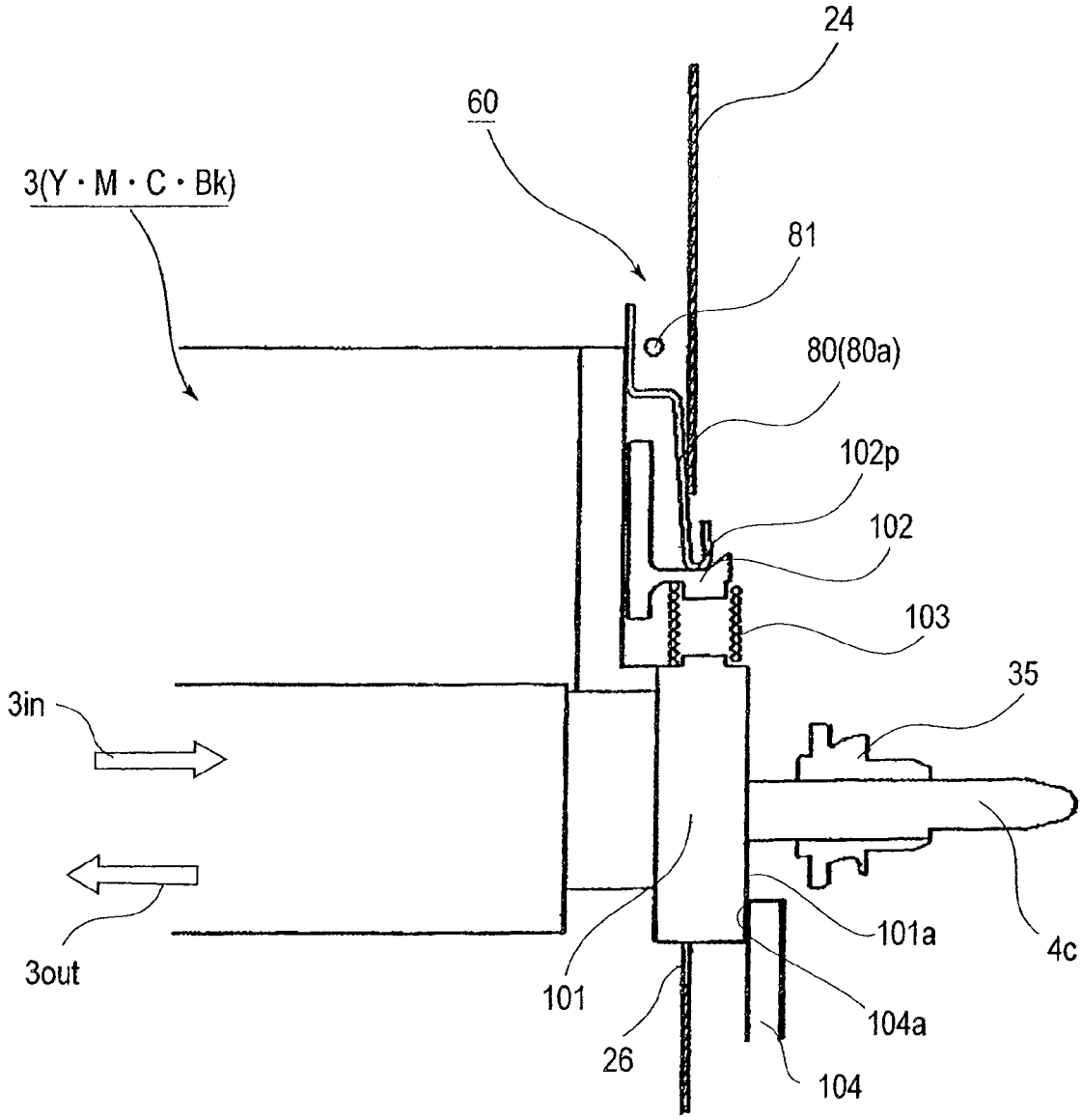
FIG. 17 is a schematic drawing (No. 1) showing how the process cartridge is kept pressed in the second embodiment of the present invention.
Figure 18:
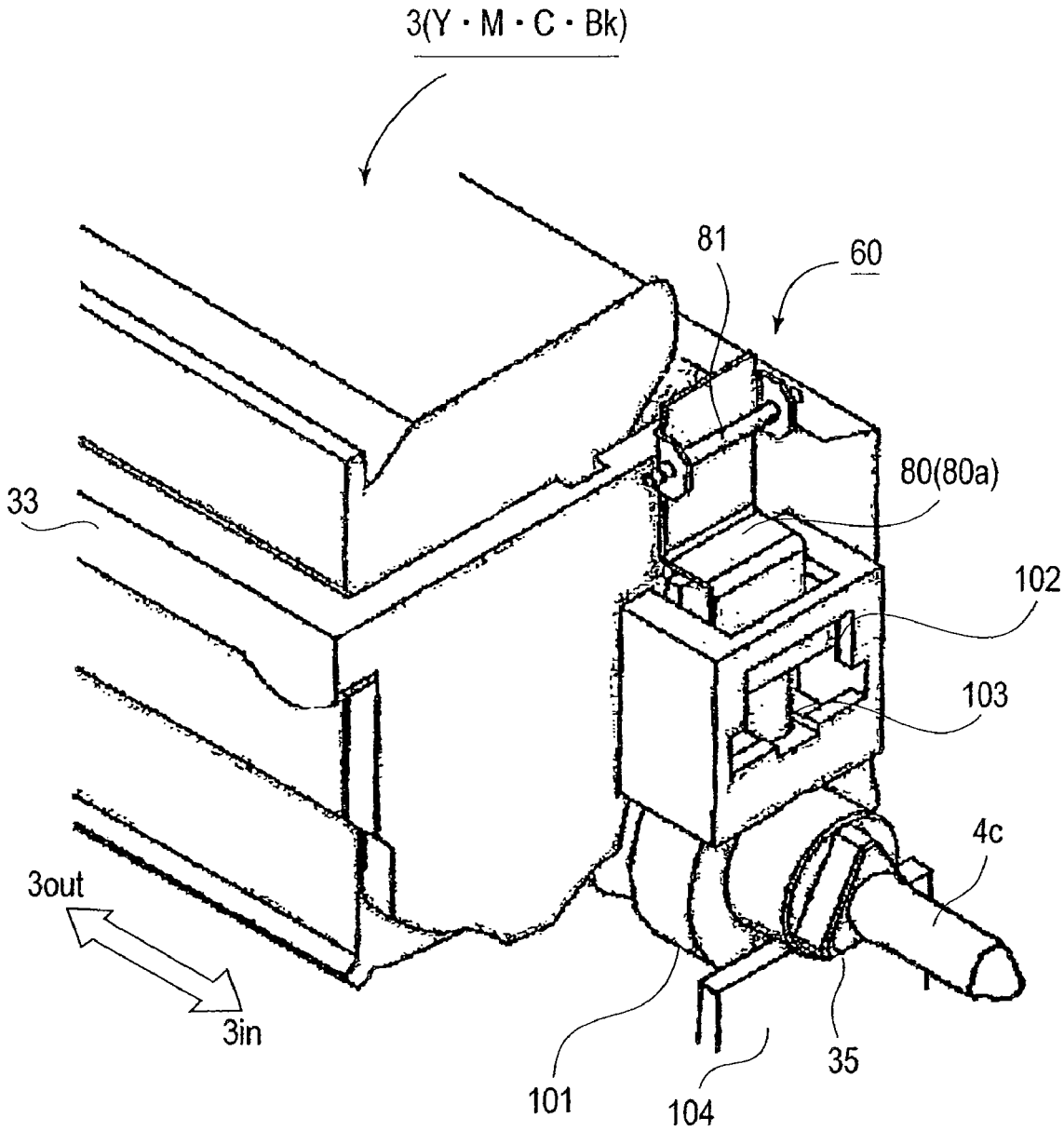
FIG. 18 is a schematic drawing (No. 2) showing how the process cartridge is kept pressed in the second embodiment of the present invention.

Referring to FIGS. 17 and 18, as the cartridge 3 is inserted in to the apparatus main assembly, the leading end surface 101*a* of the positioning member 101 of the cartridge 3 comes into contact with the contact portion 104*a* of the inward surface of the stationary member 104 of the apparatus main assembly. As a result, the cartridge 3 is prevented from being inserted further, being thereby precisely positioned relative to the apparatus main assembly 1 in terms of the thrust direction. As for the positioning of the cartridge 3 in terms of the radial direction of the photosensitive drum 4, the cartridge 3 is precisely positioned relative to the apparatus main assembly 1 by the pressing means 60.

Figure 21:
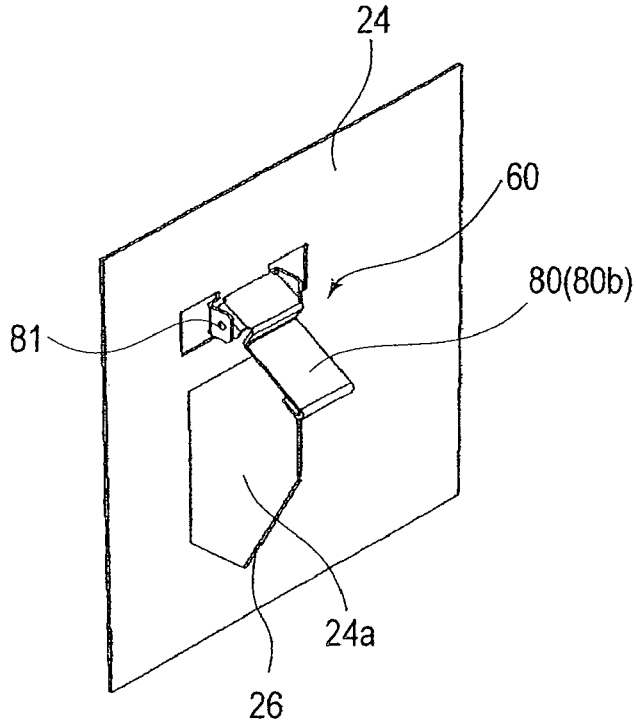
FIG. 21 is a perspective view of the cartridge pressing member, and its adjacencies, in the second embodiment of the present invention.

Referring to FIG. 21, the rear lateral plate 24 is provided with a cartridge positioning hole 24*a*, the bottom of which is provided with a V-shaped groove 26. Next, referring to FIG. 17, the positioning member 101 of the cartridge 3 is pressed upon the surfaces of the V-shaped groove 26, whereby the cartridge 3 is precisely positioned relative to the apparatus main assembly 1 in terms of the radial direction of the photosensitive drum 4.

The pressing means 60 has a pressing member 80 (arm) for pressing the cartridge 3 upon the surfaces of the V-shaped groove 26. The pressing member 80 is rotatably supported by the shaft 81 attached to the apparatus main assembly 1. The shaft 81 is parallel to the rear lateral plate 24, and perpendicular to the cartridge insertion direction 3 in.

Figure 19:
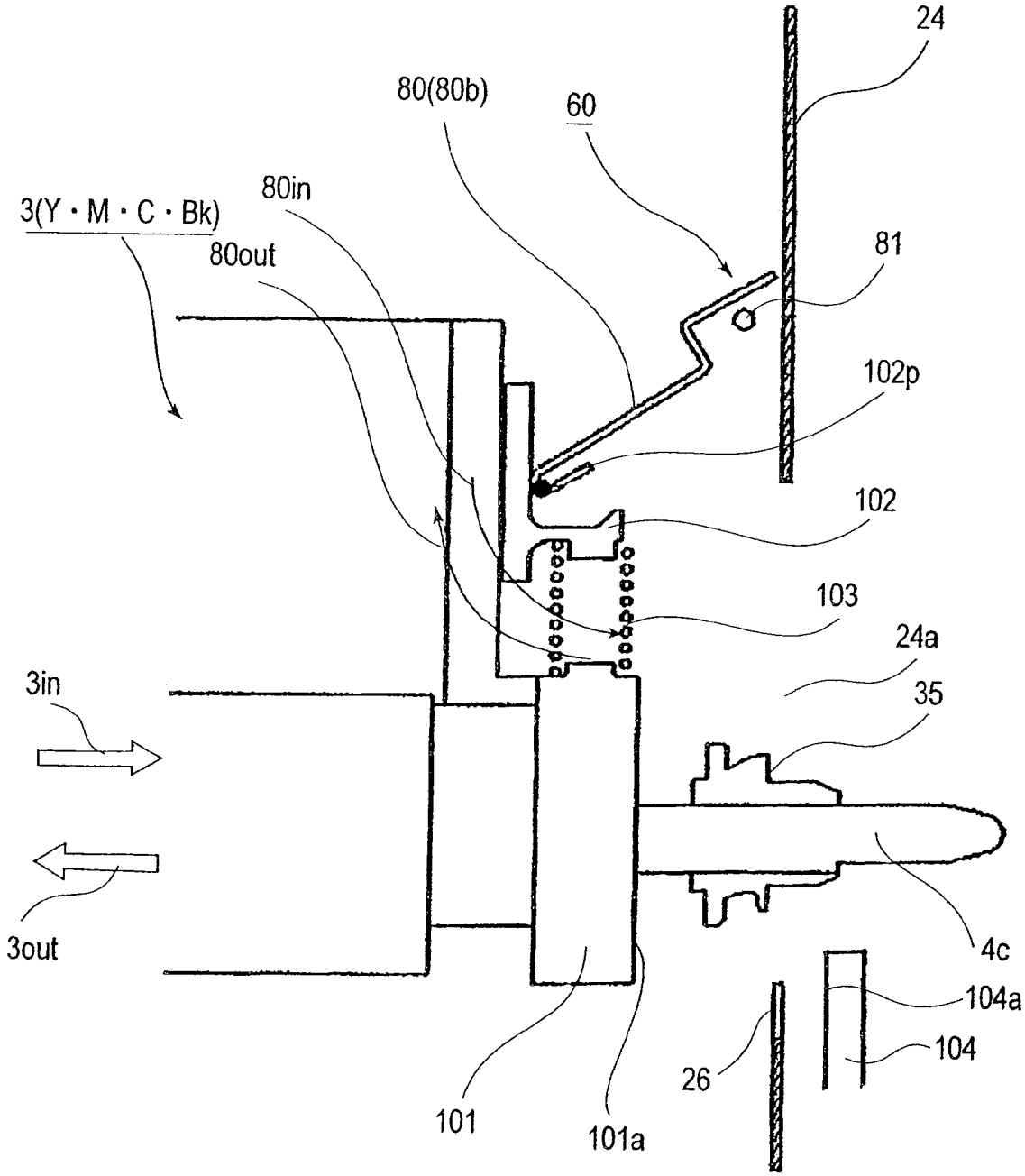
FIG. 19 is a schematic drawing (No. 1) showing the state of the cartridge positioning structure in the second embodiment of the present invention, while no force is applied to the process cartridge.
Figure 20:
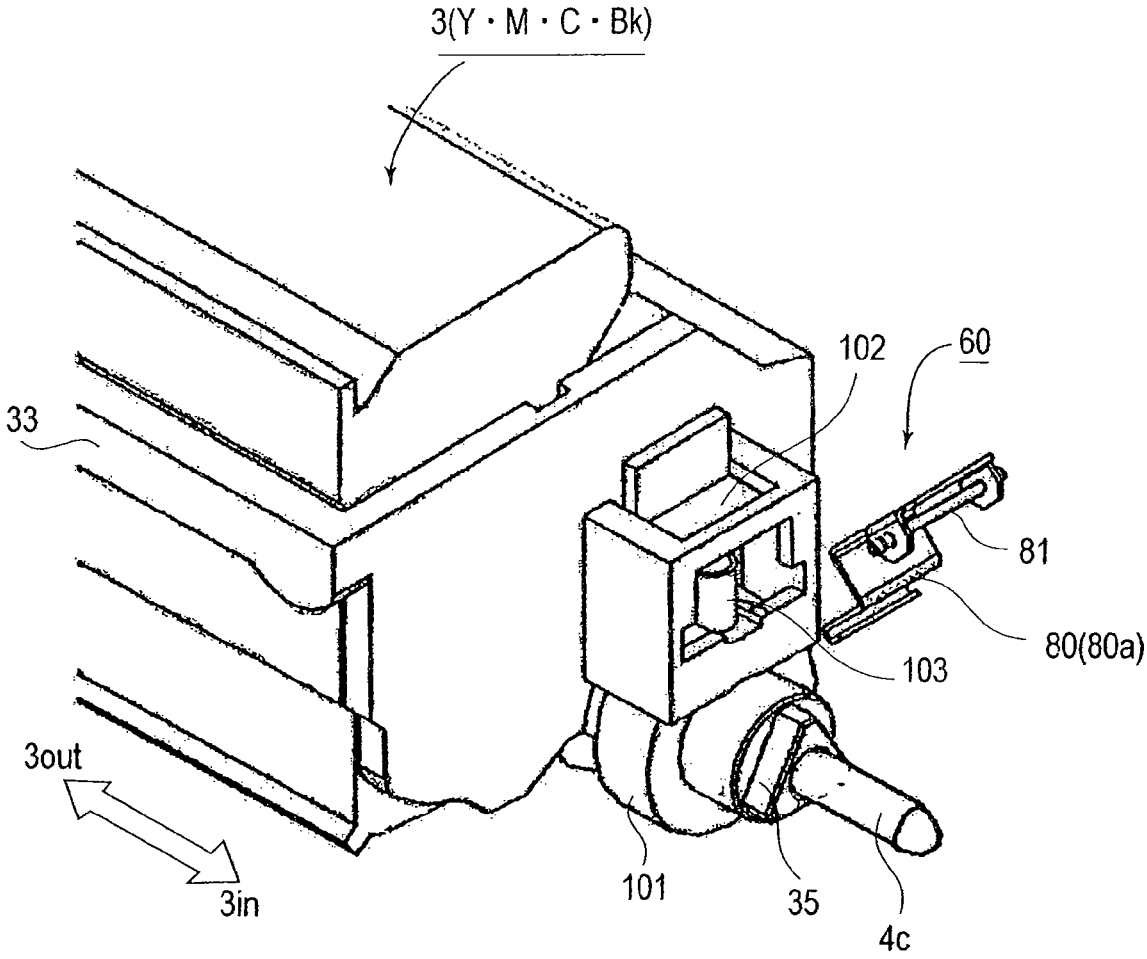
FIG. 20 is a schematic drawing (No. 2) showing the state of the cartridge positioning structure in the second embodiment of the present invention, while no force is applied to the process cartridge.

Referring to FIGS. 19 and 20, prior to the insertion of the cartridge 3, the pressing member 80 is in the position (first position) designated by a reference symbol 80*b*. After the successful completion of the mounting of the cartridge 3 into the apparatus main assembly 1 (FIGS. 17 and 18), the pressing member 80 is in contact with the pressure catching member 102 of the cartridge 3. More specifically, as the cartridge 3 is inserted into the apparatus main assembly 1, the pressuring member 80 comes into contact with the pressure catching member 102 of the cartridge 3, and then, is rotated about the shaft 81 by the inward movement of the cartridge 3 in the direction indicated by an arrow mark 80in in FIG. 19, while causing the pressure catching member 102 of the cartridge 3 to move vertically downward. As the pressure catching member 102 is moved vertically downward, the aforementioned positioning member 101 is pressed downward by the resiliency of a spring 103, being thereby pressed upon the surfaces of the V-shaped groove 26 of the cartridge positioning hole 24*a* of the apparatus main assembly 1, by the resiliency of the spring 103 (FIG. 17).

After the successful completion of the mounting of the cartridge 3 into the apparatus main assembly 1, the pressing member 80 is in the position (second position) designated by a reference symbol 80*a*, in which it remains in contact with the contact point 102*p* of the pressure catching member 102. The contact point 102*p* is on the downstream side of the shaft 81 in terms of the cartridge insertion direction. Further, the pressing member 80 is under a torque which acts in the direction indicated by the arrow mark 80in. Therefore, the pressing member 80 is made to sustain itself in the second position, yielding a constant amount of pressure for pressing the pressure catching member 102. Moreover, the moment when the contact point 102*p* moves from the upstream side of the shaft 81 to the downstream side in terms of the cartridge insertion direction, the resistance an operator has been sensing turns into a pulling force, providing the operator with a feel of clicking that assures that the cartridge 3 has just been correctly mounted.

Also, when the pressing member 80 is in the second position, there is a certain amount of pressure which acts in the direction to press downstream the cartridge 3 in terms of the cartridge insertion direction, contributing to the precise positioning of the cartridge 3 relative to the apparatus main assembly 1 in terms of the thrust direction.

When extracting the cartridge 3 in the direction indicated by an arrow head 3out in FIG. 17, torque is generated in the direction indicated by an arrow mark 80out in FIG. 19 by the function of the pressure catching member 102. As a result, the pressing member returns to the initial position 80*b* (first position).

Therefore, when mounting the cartridge 3, it is by the force applied to the cartridge 3 in the direction indicated by the arrow mark 3 in that the cartridge 3 is inserted into the apparatus main assembly 1; the cartridge 3 is pressed downward; and the cartridge is precisely positioned relative to the apparatus main assembly 1, while providing an operator with the clicking sensation. When extracting the cartridge 3, it is by the force applied to the cartridge 3 in the direction indicated by the arrow mark 3out that the cartridge 3 is relieved of the downward pressure, and is extracted from the apparatus main assembly 1. In other words, according to this embodiment, it is possible to provide an operator the clicking sensation, with the employment of the above-described simple structural arrangement, when mounting the cartridge 3 into the apparatus main assembly 1.

Embodiment 3

Figure 22:
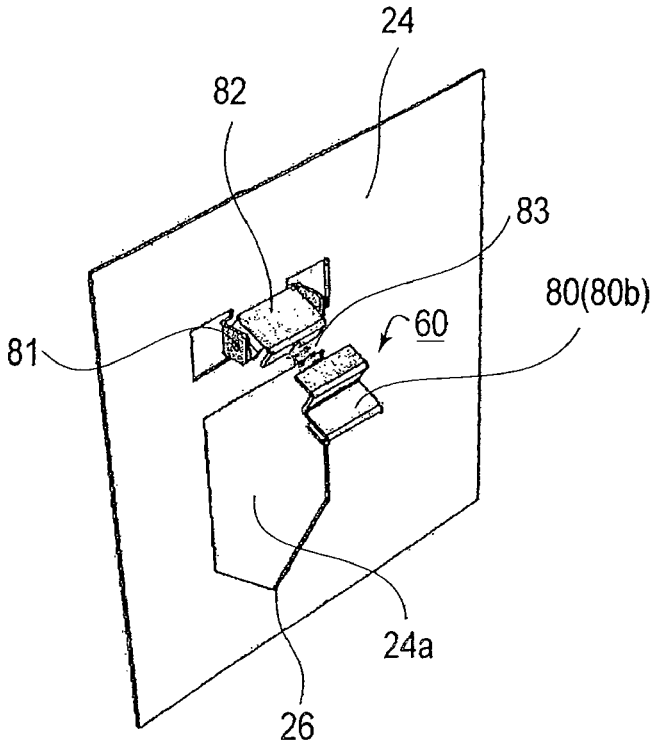
FIG. 22 is a perspective view of the cartridge pressing member, and its adjacencies, in the third embodiment of the present invention.
Figure 23:
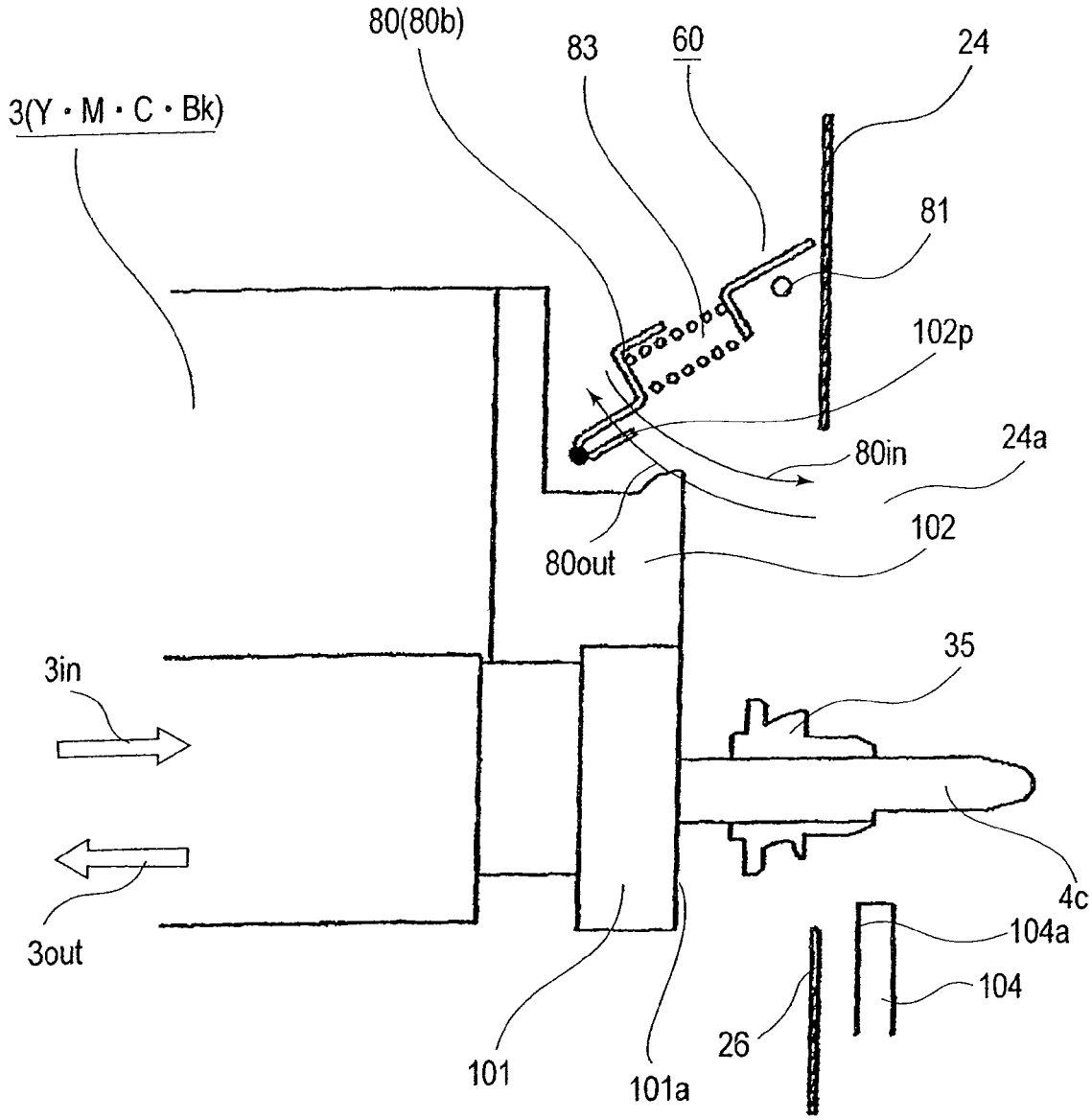
FIG. 23 is a schematic drawing of the cartridge positioning structure in the third embodiment, while the no force is applied to the process cartridge.

Next, referring to FIGS. 22, 23, and 24, the third embodiment of the present invention will be described. In this embodiment, the rotational axle 81 of the pressing means 60 is solidly attached to the apparatus main assembly 1 as shown in FIGS. 22 and 23. A rotatable member 83 is rotatably supported by the shaft 81. There is disposed a spring 83 between the pressing member 80 and rotatable member 82, with the pressing member 80 allowed to freely move in the direction in which the spring 83 is compressed or allowed to expand.

Figure 24:
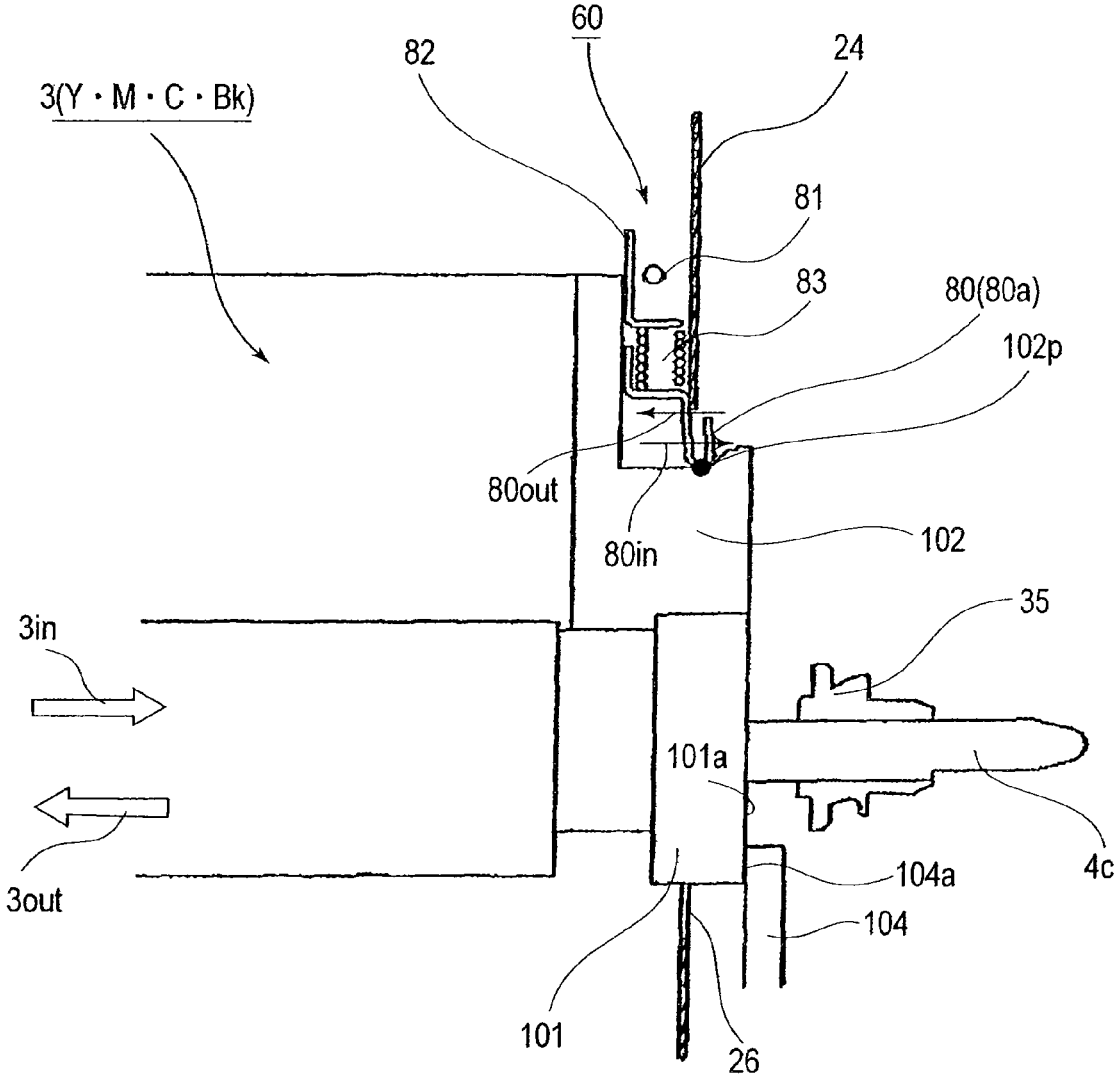
FIG. 24 is schematic drawing of the cartridge positioning structure in the third embodiment, after the successful completion of the mounting of the process cartridge.

Referring to FIG. 24, as the cartridge 3 is inserted into the apparatus main assembly 1, the pressure catching member 102 comes into contact with the pressing member 80, and then, rotates the pressing member 80 in the direction indicated by an arrow mark 80in, while being subjected to the pressure generated by the resiliency of the spring 83 which acts on the pressure catching portion 102. As a result, the cartridge positioning means 101 of the cartridge 3 is pressed upon the surfaces of the V-shaped groove 26, whereby the cartridge 3 is precisely positioned relative to the apparatus main assembly 1.

Also referring to FIG. 24, the distance between the contact point 102*p* by which the pressing member 80 presses the pressure catching member 102, and the shaft 81, is shorter after the successful completion of the mounting of the cartridge 3 into the apparatus main assembly 1 than prior to the mounting of the cartridge 3. Therefore, after the completion of the mounting of the cartridge 3, the pressing member 80 remains under the pressure from the spring 83.

Embodiment 4

Figure 25:
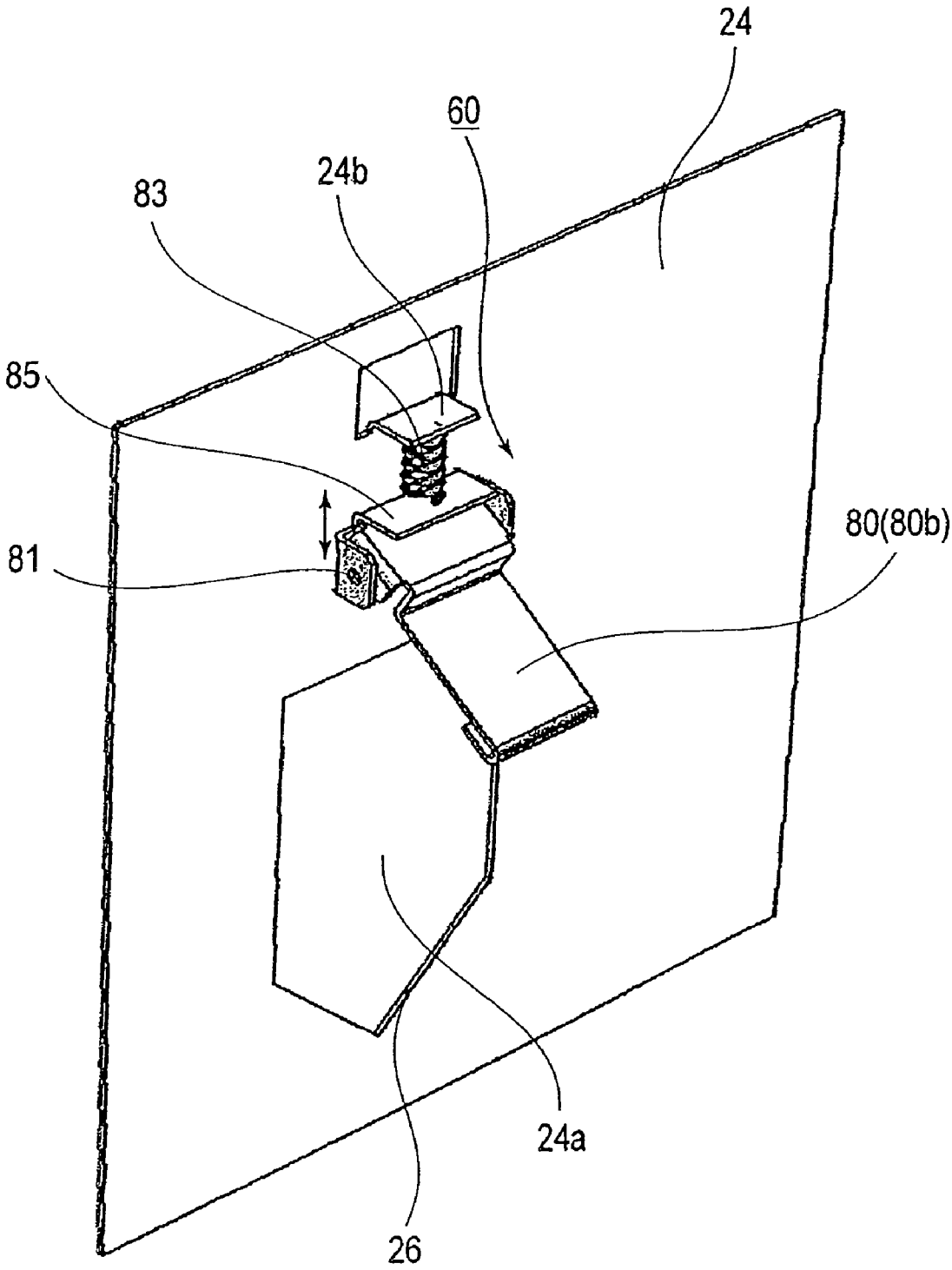
FIG. 25 is a perspective view of the cartridge pressing member, and its adjacencies, in the fourth embodiment of the present invention.
Figure 26:
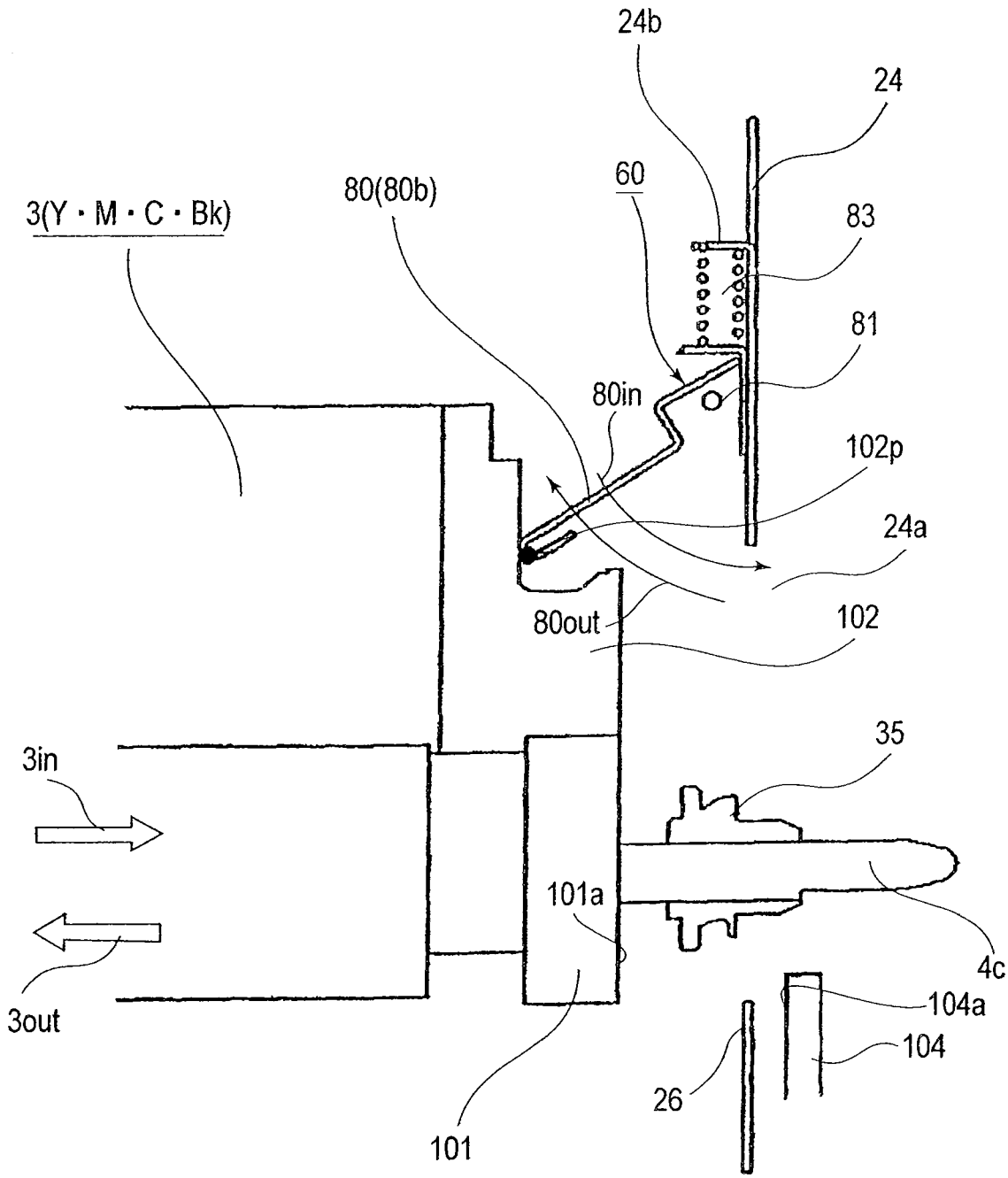
FIG. 26 is a schematic drawing of the cartridge positioning structure in the fourth embodiment, while no force is applied to the process cartridge.
Figure 27:
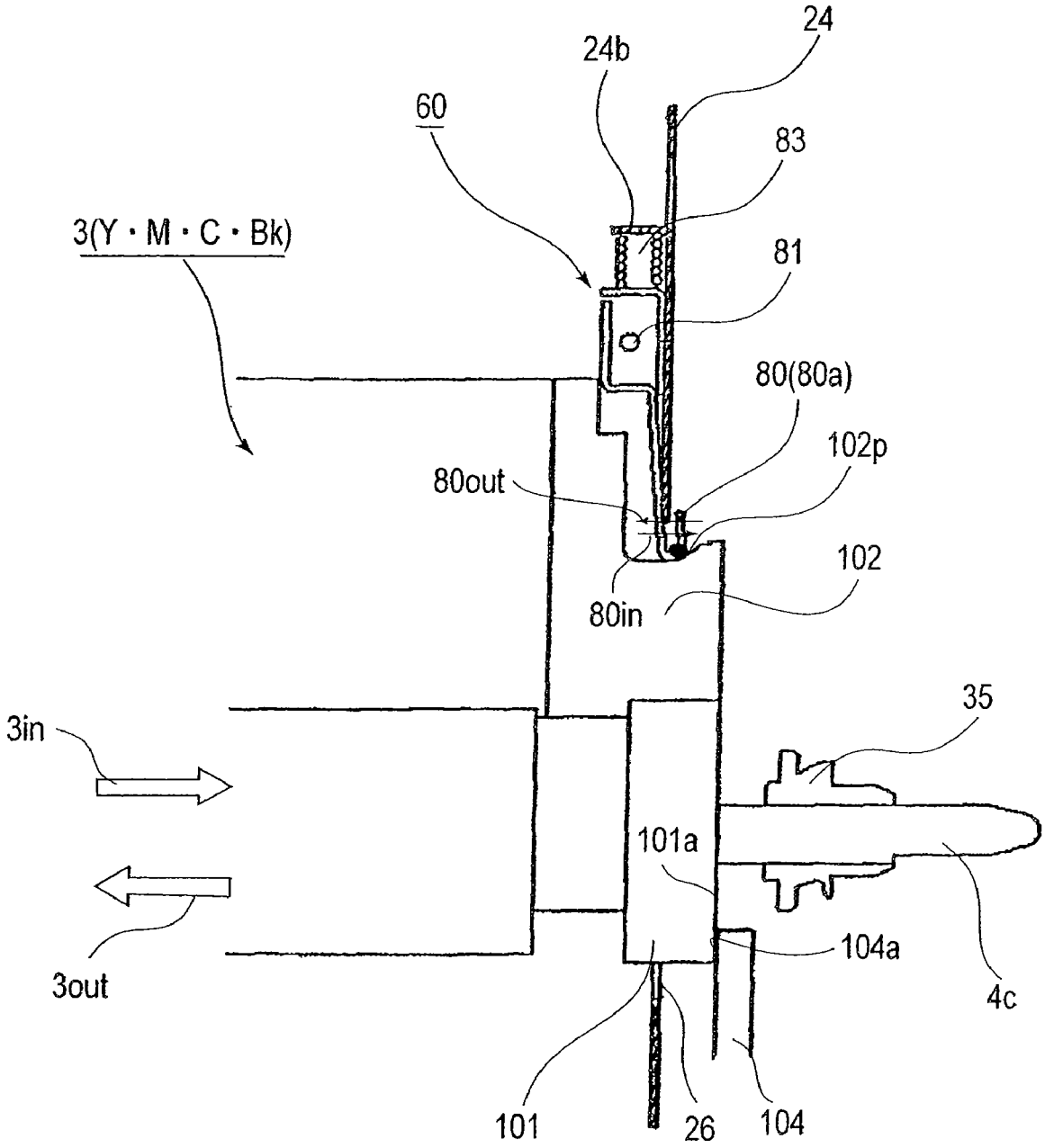
FIG. 27 is a schematic drawing of the cartridge positioning structure in the fourth embodiment, after the successful completion of the mounting of the process cartridge.

FIGS. 25, 26, and 27 depict the fourth embodiment of the present invention. Referring to FIG. 25, in this embodiment, the rear lateral plate 24 is provided with a movable plate 85, which is attached to the rear lateral plate 24 so that it is allowed to move relative to the apparatus main assembly 1 in a direction parallel to the direction in which pressure is applied thereto. Pressure (reactive force) is transmitted to the movable plate 85 from the perpendicularly bent portion 24*b* of the rear lateral plate 24 through the spring 83. The shaft 81 is solidly attached to the floating plate 85, and the pressing member 80 is rotatably supported by the shaft 81.

Referring to FIG. 27, as the cartridge 3 is inserted into the apparatus main assembly 1, the pressure catching member 102 comes into contact with the pressing member 80, and rotates the pressing member 80 in the direction indicated by an arrow mark 80in. As a result, the pressure catching member 102 is pressed downward by the pressing member 80, pressing thereby the cartridge positioning means 101 upon the surfaces of the V-shaped groove 26. Consequently, the cartridge 3 is precisely positioned relative to the apparatus main assembly 1.

Also referring to FIG. 27, the distance between the contact point 102*p* by which the pressing member 80 presses the pressure catching member 102, and the perpendicularly bent portion 24*b* of the rear lateral plate 24, is shorter after the successful completion of the mounting of the cartridge 3 into the apparatus main assembly 1 than prior to the mounting of the cartridge 3. Therefore, after the completion of the mounting of the cartridge 3, the spring 83 applies pressure upon the pressing member 80, and this pressure is transmitted to the cartridge 3 through the shaft 81 and pressing member 80, pressing thereby the cartridge 3.

The preceding embodiments of the present invention were described with reference to the full-color image forming apparatus. However, the present invention is also applicable to the cartridge positioning structural arrangement for a monochromatic image forming apparatus in which only a single process cartridge is removably mounted, which is obvious.

In summary, according to the above described embodiments of the present invention, as the cartridge 3 is mounted into the apparatus main assembly 1, the inward movement of the cartridge 3 makes the cartridge 3 to be pressed upon the cartridge positioning portion 26, precisely positioning thereby the photosensitive drum 4 relative to the apparatus main assembly 1. Further, the amount of force required to mount the cartridge 3 into the apparatus main assembly 1 is substantially smaller than that required to mount a cartridge in accordance with the prior art into the main assembly of an image forming apparatus. Moreover, the abovementioned advantageous characteristics can be realized by the employment of the simple structural arrangements for the process cartridge and the main assembly of the image forming apparatus. Thus, it is possible for an operator to mount or dismount the cartridge 3, more easily and with the application of a substantially smaller amount of force (compared to the level of ease with which a cartridge in accordance with the prior art can be mounted or dismounted) than the amount of force required to mount or dismount a process cartridge in accordance with the prior art.

Further, from virtually the same point in time as the time of the successful completion of the mounting of the cartridge 3 into the apparatus main assembly 1, the pressing member 80 begins to be kept, by its own resiliency, in the second position in which it continuously presses the cartridge positioning member (pressure catching member). Therefore, once the cartridge 3 is successfully mounted into the apparatus main assembly 1, the cartridge 3 does not deviate in position unless an external force is applied thereto. Further, the cartridge 3 is placed directly in contact with the apparatus main assembly 1 for the purpose of positioning the cartridge 3 relative to the apparatus main assembly 1. Therefore, the cartridge 3 is positioned relative to the apparatus main assembly 1 with a substantially higher level of precision relative to the apparatus main assembly 1 compared to the level of precision at which a cartridge in accordance with the prior art is positioned relative to the apparatus main assembly 1. Further, according to the preceding embodiments, the insertion, positioning, and pressing (retention) of the process cartridge can be accomplished through a single motion, drastically improving the process cartridge in operational efficiency.

As described above, according to the present invention, a process cartridge can be more precisely positioned relative to the main assembly of an electrophotographic image forming apparatus than according to the prior art. Further, a process cartridge can be substantially improved in terms of the level of operability at which the process cartridge is mountable into the main assembly of an electrophotographic image forming apparatus. Further, the amount of force required to mount a process cartridge into the main assembly of an electrophotographic image forming apparatus can be substantially reduced.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 044501/2004 and 031850/2005 filed Feb. 20, 2004 and Feb. 8, 2005, respectively, which are hereby incorporated by reference.

What is claimed is:

1. A process cartridge detachably mountable to a main assembly of an electrophotographic image forming apparatus, said process cartridge comprising:

an electrophotographic photosensitive drum;

process means actable on said electrophotographic photosensitive drum;

a cartridge positioning portion configured and positioned to engage a main assembly positioning portion provided in the main assembly of the apparatus to position said process cartridge with respect to a direction of the axis of said electrophotographic photosensitive drum, when said process cartridge is mounted to the main assembly of the apparatus in a direction parallel with the axis of said photosensitive drum; and a member to be urged provided at a downstream portion of said process cartridge with respect to a mounting direction in which said process cartridge is mounted to the main assembly of the apparatus, said member to be urged including a first portion to be urged configured and positioned to contact a movable urging member provided in the main assembly of the apparatus to move the movable urging member in the downstream direction with respect to the mounting direction in the process of mounting of said process cartridge to the main assembly of the apparatus, and a second portion to be urged configured and positioned to contact the movable urging member to receive a force in the direction of the axis so as to contact said cartridge positioning portion to the main assembly positioning portion to position said process cartridge in the direction of the axis, when said process cartridge is mounted to the main assembly of the apparatus, wherein said member to be urged has an engaging portion configured and positioned to engage the movable urging member for moving the movable urging member in the upstream direction with respect to the mounting direction when said process cartridge is demounted from the main assembly of the apparatus.

2. An electrophotographic image forming apparatus, for forming an image on a recording material, to which a process cartridge is detachably mountable, said apparatus comprising:

(i) a main assembly positioning portion provided in a main assembly of said apparatus;

(ii) a movable urging member provided in the main assembly of said apparatus;

(iii) mounting means for detachably mounting the process cartridge, the process cartridge including an electrophotographic photosensitive drum, process means actable on the electrophotographic photosensitive drum, a cartridge positioning portion configured and positioned to engage said main assembly positioning portion to position the process cartridge in a direction of the axis of the electrophotographic photosensitive drum, when the process cartridge is mounted to the main assembly of said apparatus in a direction parallel with the axis of the photosensitive drum, and a member to be urged provided at a downstream portion of the process cartridge with respect to a mounting direction in which the process cartridge is mounted to the main assembly of said apparatus, the member to be urged including a first portion to be urged configured and positioned to contact said movable urging member to move said movable urging member in the downstream direction with respect to the mounting direction in the process of mounting of the process cartridge to the main assembly of said apparatus, and a second portion to be urged configured and positioned to contact said movable urging member to receive a force in the direction of the axis so as to contact the cartridge positioning portion to said main assembly positioning portion to position the process cartridge in the direction of the axis, when the process cartridge is mounted to the main assembly of said apparatus; and (iv) feeding means for feeding the recording material, wherein said movable urging member includes a supporting portion rotatably supported on a shaft extending in a direction substantially perpendicular to the mounting direction of the process cartridge in the main assembly of said apparatus, and an acting portion configured and positioned to contact the member to be urged.

3. An apparatus according to claim 2, wherein said movable urging member includes a spring member, disposed between said supporting portion and said acting portion, configured and positioned to urge said acting portion away from said supporting portion.

* * * * *